US009072152B2

(12) United States Patent
Wakabayashi et al.

(10) Patent No.: US 9,072,152 B2
(45) Date of Patent: Jun. 30, 2015

(54) EXTREME ULTRAVIOLET LIGHT GENERATION SYSTEM UTILIZING A VARIATION VALUE FORMULA FOR THE INTENSITY

(75) Inventors: Osamu Wakabayashi, Hiratsuka (JP); Tatsuya Yanagida, Hiratsuka (JP)

(73) Assignee: GIGAPHOTON INC., Tochigi (JP)

( * ) Notice: Subject to any disclaimer, the term of this patent is extended or adjusted under 35 U.S.C. 154(b) by 0 days.

(21) Appl. No.: 13/523,446

(22) Filed: Jun. 14, 2012

(65) Prior Publication Data

US 2012/0248344 A1 Oct. 4, 2012

Related U.S. Application Data

(63) Continuation-in-part of application No. PCT/JP2011/056820, filed on Mar. 22, 2011.

(30) Foreign Application Priority Data

| | | |
|---|---|---|
| Mar. 29, 2010 | (JP) | 2010-074256 |
| Nov. 29, 2010 | (JP) | 2010-265791 |
| Jan. 27, 2011 | (JP) | 2011-015695 |
| Mar. 16, 2011 | (JP) | 2011-058026 |
| Jun. 15, 2011 | (JP) | 2011-133112 |
| Sep. 15, 2011 | (JP) | 2011-201750 |

(51) Int. Cl.
*H05G 2/00* (2006.01)

(52) U.S. Cl.
CPC ..... *H05G 2/008* (2013.01); *H05G 2/005* (2013.01)

(58) Field of Classification Search
CPC ..... H05G 2/00–2/08
USPC ..... 250/504 R
See application file for complete search history.

(56) References Cited

U.S. PATENT DOCUMENTS

| | | | | |
|---|---|---|---|---|
| 4,443,696 | A * | 4/1984 | Taboada | 250/205 |
| 5,799,024 | A * | 8/1998 | Bowers et al. | 372/11 |
| 5,991,360 | A | 11/1999 | Matsui et al. | |
| 6,031,241 | A | 2/2000 | Silfvast et al. | |
| 7,091,507 | B2 * | 8/2006 | Masaki et al. | 250/504 R |
| 7,239,686 | B2 | 7/2007 | Berglund et al. | |
| 7,308,007 | B2 | 12/2007 | Rocca et al. | |
| 7,317,192 | B2 | 1/2008 | Ma | |
| 2002/0041418 | A1 * | 4/2002 | Fillion et al. | 359/201 |

(Continued)

FOREIGN PATENT DOCUMENTS

| | | |
|---|---|---|
| JP | 09-232694 | 9/1997 |
| JP | 10-221499 A | 8/1998 |

(Continued)

OTHER PUBLICATIONS

Office Action Japanese Patent Application No. 2011-058026 dated Jul. 8, 2014 with partial English translation.

(Continued)

*Primary Examiner* — Phillip A Johnston
*Assistant Examiner* — Sean Luck
(74) *Attorney, Agent, or Firm* — Studebaker & Brackett PC

(57) ABSTRACT

An apparatus used with a laser apparatus may include a chamber, a target supply for supplying a target material to a region inside the chamber, a laser beam focusing optical system for focusing a laser beam from the laser apparatus in the region, and an optical system for controlling a beam intensity distribution of the laser beam.

10 Claims, 19 Drawing Sheets

(56) References Cited

U.S. PATENT DOCUMENTS

| | | | | |
|---|---|---|---|---|
| 2004/0057470 | A1 | 3/2004 | Rhodes et al. | |
| 2005/0117620 | A1 | 6/2005 | Thro et al. | |
| 2005/0178979 | A1 | 8/2005 | Masaki et al. | |
| 2005/0205811 | A1 | 9/2005 | Partlo et al. | |
| 2006/0215712 | A1* | 9/2006 | Ziener et al. | 372/2 |
| 2007/0007469 | A1 | 1/2007 | Murakami et al. | |
| 2007/0086713 | A1* | 4/2007 | Ingmar et al. | 385/122 |
| 2007/0090304 | A1 | 4/2007 | Jonkers et al. | |
| 2007/0242705 | A1 | 10/2007 | Faure et al. | |
| 2008/0015662 | A1 | 1/2008 | Tunnermann et al. | |
| 2008/0149862 | A1 | 6/2008 | Hansson et al. | |
| 2008/0179548 | A1 | 7/2008 | Bykanov et al. | |
| 2009/0027753 | A1* | 1/2009 | Lizotte | 359/238 |
| 2010/0040105 | A1 | 2/2010 | Rocca et al. | |

FOREIGN PATENT DOCUMENTS

| | | | |
|---|---|---|---|
| JP | 2000-299197 | A | 10/2000 |
| JP | 2003-270551 | | 9/2003 |
| JP | 2003-270551 | A | 9/2003 |
| JP | 2003-272892 | | 9/2003 |
| JP | 2004-006716 | | 1/2004 |
| JP | 2005-235959 | | 9/2005 |
| JP | 2005-276673 | | 10/2005 |
| JP | 2008-103151 | | 5/2008 |
| JP | 2009-105006 | A | 5/2009 |

OTHER PUBLICATIONS

U.S. Appl. No. 13/572,248 dated Jan. 9, 2014.
U.S. Appl. No. 13/572,248 dated Jul. 3, 2014.
Office Action issued in U.S. Appl. No. 13/572,248 mailed Jun. 6, 2013.

* cited by examiner

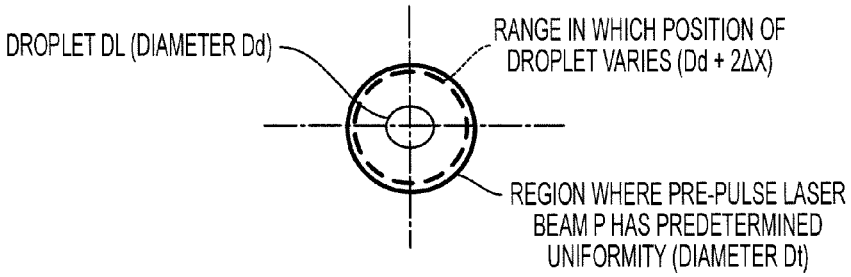
FIG. 4A
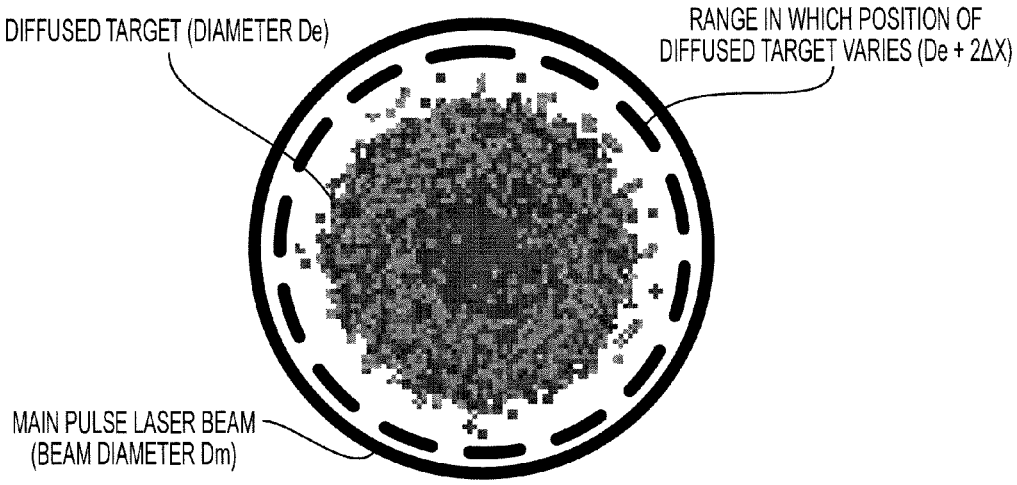
FIG. 4B
| VARIATION ΔX OF DROPLET | PROBABILITY OF DROPLET NOT IRRADIATED WITH UNIFORM REGION |
|---|---|
| 1σ | $1.59 \times 10^{-1}$ |
| 2σ | $2.28 \times 10^{-2}$ |
| 3σ | $1.35 \times 10^{-3}$ |
| 4σ | $3.17 \times 10^{-5}$ |
| 5σ | $2.87 \times 10^{-7}$ |
| 6σ | $9.87 \times 10^{-10}$ |
| 7σ | $1.28 \times 10^{-12}$ |
| 8σ | $6.22 \times 10^{-16}$ |
| 9σ | $1.13 \times 10^{-19}$ |
| 10σ | $7.62 \times 10^{-24}$ |
FIG. 5

| | CASE 1 | CASE 2 | CASE 3 | CASE 4 |
|---|---|---|---|---|
| BEAM DIAMETER | TOP-HAT | TOP-HAT | TOP-HAT | TOP-HAT |
| PULSE ENERGY E (mJ) | 0.3 | 0.3 | 0.3 | 0.5 |
| PULSE DURATION T (ns) | 20 | 10 | 0.1 | 0.05 |
| DIAMETER OF UNIFORM REGION Dt (μm) | 30 | 30 | 30 | 30 |
| BEAM INTENSITY W ($W/cm^2$) | $2.12 \times 10^9$ | $4.24 \times 10^9$ | $4.24 \times 10^{11}$ | $1.41 \times 10^{12}$ |

FIG. 21

EXTREME ULTRAVIOLET LIGHT GENERATION SYSTEM UTILIZING A VARIATION VALUE FORMULA FOR THE INTENSITY

CROSS-REFERENCE TO RELATED APPLICATIONS

The present application is a continuation-in-part of International Application PCT/JP2011/056820, with an international filing date of Mar. 22, 2011, which claims priority from Japanese Patent Application No. 2010-074256 filed Mar. 29, 2010, Japanese Patent Application No. 2010-265791 filed Nov. 29, 2010, Japanese Patent Application No. 2011-015695 filed Jan. 27, 2011, and Japanese Patent Application No. 2011-058026 filed Mar. 16, 2011. The present application further claims priority from Japanese Patent Application No. 2011-133112 filed Jun. 15, 2011, and Japanese Patent Application No. 2011-201750 filed Sep. 15, 2011.

BACKGROUND

1. Technical Field

This disclosure relates to an extreme ultraviolet (EUV) light generation system.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used.

SUMMARY

An apparatus according to one aspect of this disclosure may be used with a laser apparatus and may include a chamber, a target supply for supplying a target material to a region inside the chamber, a laser beam focusing optical system for focusing a laser beam from the laser apparatus in the region, and an optical system for controlling a beam intensity distribution of the laser beam.

A system for generating extreme ultraviolet light according to another aspect of this disclosure may include a laser apparatus, a chamber, a target supply for supplying a target material to a region inside the chamber, a laser beam focusing optical system for focusing the laser beam in the region inside the chamber, an optical system for adjusting a beam intensity distribution of the laser beam, and a laser controller for controlling a timing at which the laser beam is outputted from the laser apparatus.

BRIEF DESCRIPTION OF THE DRAWINGS

FIG. 4A shows the relationship between a diameter of a droplet and a diameter of a pre-pulse laser beam in this disclosure, as viewed in the direction of the beam axis.

FIG. 4B shows the relationship between a diameter of a diffused target and a diameter of a main pulse laser beam in this disclosure, as viewed in the direction of the beam axis.

FIG. 5 is a table showing examples of a variation ΔX in the position of a droplet.

FIG. 21 is a table showing examples of irradiation conditions of the pre-pulse laser beam in this disclosure.

DESCRIPTION

Figure 1A:
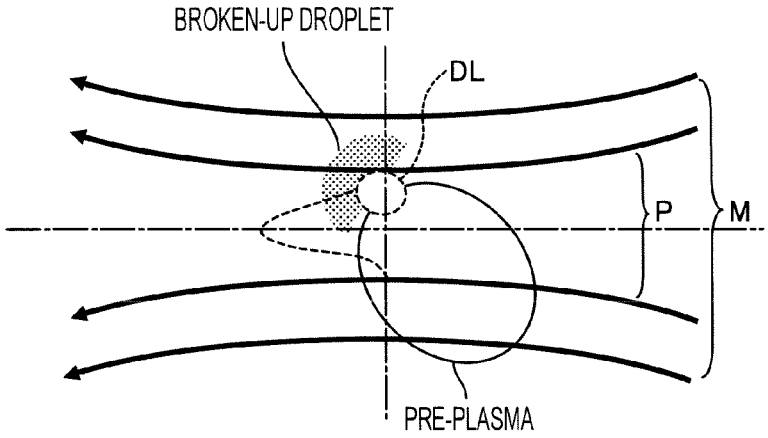
FIGS. 1A through 1C are diagrams for discussing a technical issue pertaining to this disclosure.

Hereinafter, selected embodiments of this disclosure will be described in detail with reference to the accompanying drawings. The embodiments to be described below are merely illustrative in nature and do not limit the scope of this disclosure. Further, the configuration(s) and operation(s) described in each embodiment are not all essential in implementing this disclosure. Note that like elements are referenced by like reference numerals and characters, and duplicate descriptions thereof will be omitted herein.

Contents

Figure 1B:
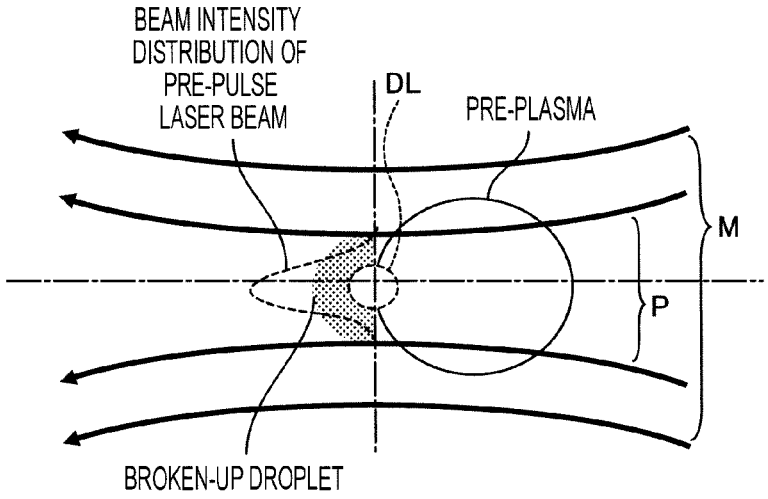
Figure 1C:
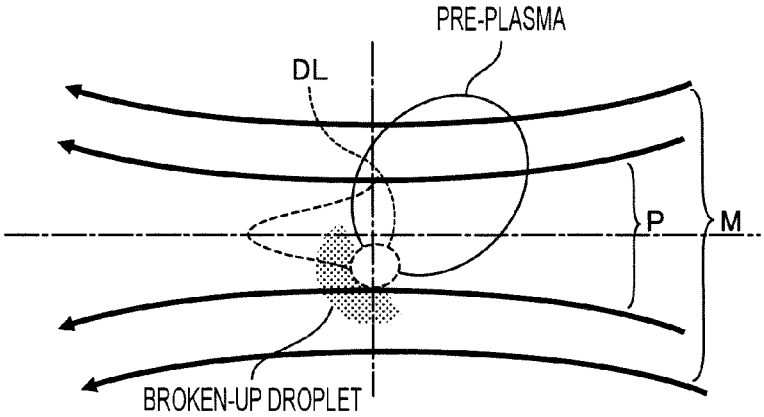

1. Background of Embodiments
2. Overview of Embodiments
3. Diameter of Region of Substantial Uniformity
4. Examples of Beam Intensity Distribution
5. First Embodiment
6. Examples of Beam-Shaping Optical systems
7. Second Embodiment
8. Third Embodiment
9. Fourth Embodiment
10. Fifth Embodiment
11. Sixth Embodiment
12. Irradiation Conditions of Pre-pulse Laser Beam
13. Seventh Embodiment
14. Eighth Embodiment
15. Ninth Embodiment
15.1 Configuration
15.2 Operation
16. Control of Fluence
17. Control of Delay Time 1. Background Of Embodiments FIGS. 1A through 1C are diagrams for discussing a technical issue pertaining to this disclosure. FIGS. 1A through 1C each shows that a droplet DL of a target material is irradiated with a pre-pulse laser beam P. It is preferable that the pre-pulse laser beam P strikes the droplet DL at a timing at which the droplet DL reaches the intersection of dash-dotted lines as shown in FIG. 1B.

Although it varies depending on conditions such as the diameter of the droplet DL and the beam intensity of the pre-pulse laser beam P, when the droplet DL is irradiated with the pre-pulse laser beam P, pre-plasma may be generated from a surface of the droplet DL that has been irradiated with the pre-pulse laser beam P. As shown in FIG. 1B, the pre-plasma may jet out in a direction substantially opposite to the direction in which the pre-pulse laser beam P travels. The pre-plasma may be a vaporized target material that includes ions and neutral particles of the target material generated from the surface of the droplet DL that has been irradiated with the pre-pulse laser beam P. The phenomenon where the pre-plasma is generated is referred to as laser ablation.

Further, when the droplet DL is irradiated with the pre-pulse laser beam P, the droplet DL may be broken up. As shown in FIG. 1B, the broken-up droplet DL may be diffused in a direction in which the pre-pulse laser beam P travels due to the reaction force of the jetting-out pre-plasma.

Hereinafter, a target that includes at least one of the pre-plasma and the broken-up droplet generated when a droplet is irradiated with a pre-pulse laser beam may be referred to as a diffused target.

The position of the droplet DL relative to the center of the pre-pulse laser beam P at the time of irradiating the droplet DL with the pre-pulse laser beam P may vary. As shown in FIG. 1A, the position of the droplet DL may be offset upwardly from the intersection of the dash-dotted lines. As shown in FIG. 1C, the position of the droplet DL may also be offset downwardly from the intersection of the dash-dotted lines. To counter this, in one method, it may be possible to increase the diameter of the pre-pulse laser beam so that the pre-pulse laser beam can strike the droplet even when the position of the droplet relative to the pre-pulse laser beam varies.

Typically, the beam intensity distribution of a laser beam outputted from a laser apparatus is in a Gaussian distribution. Because of the Gaussian distribution as shown by the dotted lines in FIGS. 1A through 1C, the pre-pulse laser beam P may have a higher beam intensity around at its center portion around the beam axis, but has a lower beam intensity at its peripheral portion. When the droplet DL is irradiated with the pre-pulse laser beam P having such a beam intensity distribution, there is a possibility for the droplet DL to be irradiated with the pre-pulse laser beam P such that the center of the droplet DL is offset from the beam axis of the pre-pulse laser beam P, as shown in FIGS. 1A and 1C.

When the droplet DL is irradiated with the pre-pulse laser beam P of the Gaussian beam intensity distribution such that the center of the droplet DL is offset from the beam axis of the pre-pulse laser beam P, the energy of the pre-pulse laser beam P may be provided disproportionately to the droplet DL. That is, the energy of the pre-pulse laser beam P may be provided intensively to a part of the droplet DL which is closer to the center of the Gaussian beam intensity distribution in the pre-pulse laser beam P (see FIGS. 1A and 1C). As a result, the pre-plasma may jet out in a direction that is different from the beam axis of the pre-pulse laser beam P. Further, the aforementioned broken-up droplet may be diffused in a direction that is different from the beam axis of the pre-pulse laser beam P due to the reaction force of the jetting-out pre-plasma.

In this way, a diffused target which is generated when a droplet is irradiated with a pre-pulse laser beam having the Gaussian beam intensity distribution may be diffused in a direction that is different from the direction of the beam axis depending on the position of the droplet relative to the beam axis of the pre-pulse laser beam when the droplet is irradiated with the pre-pulse laser beam. Accordingly, it may become difficult to irradiate the diffused target stably with a main pulse laser beam.

2. Overview Of Embodiments

Figure 2A:
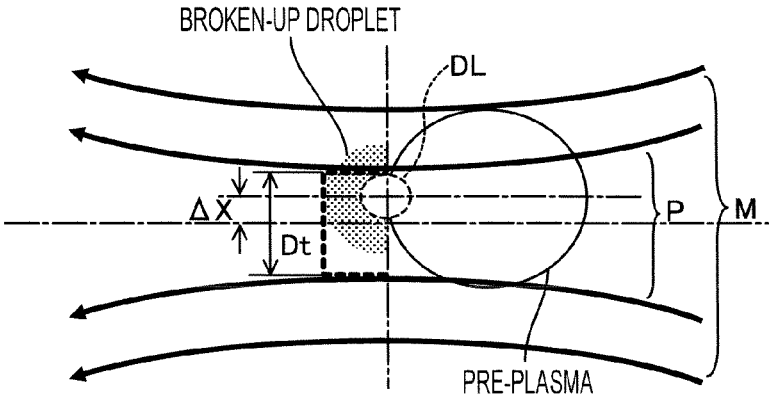
FIGS. 2A through 2C each show a droplet of a target material being irradiated with a pre-pulse laser beam in this disclosure.
Figure 2B:
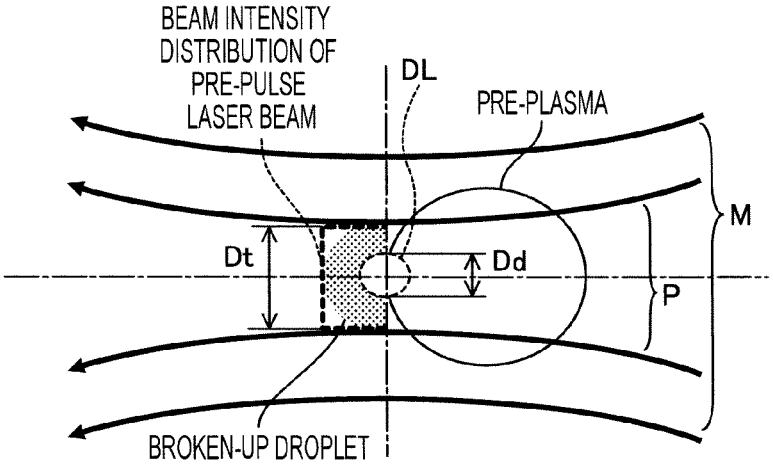
Figure 2C:
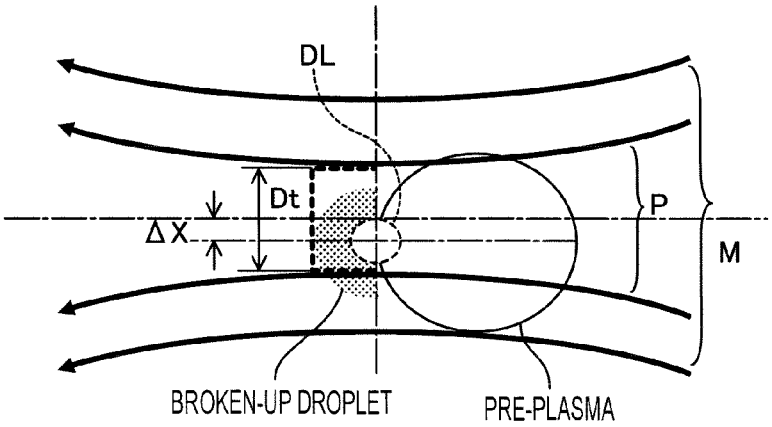

FIGS. 2A through 2C each show a droplet of a target material irradiated with a pre-pulse laser beam in this disclosure. As shown in FIGS. 2A through 2C, as in the cases shown in FIGS. 1A through 1C, the position of the droplet DL relative to the beam axis of the pre-pulse laser beam P when the droplet DL is irradiated with the pre-pulse laser beam P may vary. However, in the cases shown in FIGS. 2A through 2C, the pre-pulse laser beam P may have such a beam intensity distribution that includes a region (diameter Dt) where the beam intensity along a cross-section of the pre-pulse laser beam P has substantial uniformity.

In the cases shown in FIGS. 2A through 2C, the droplet DL is located within the region (diameter Dt) where the beam intensity along the cross-section of the pre-pulse laser beam P has substantial uniformity. Thus, the droplet DL may be irradiated with the pre-pulse laser beam P with substantially uniform beam intensity across the irradiation surface of the droplet DL. Accordingly, even when the position of the droplet DL relative to the beam axis of the pre-pulse laser beam P varies when the droplet DL is irradiated with the pre-pulse laser beam P, the target material forming the droplet DL may be diffused in a direction perpendicular to the beam axis of the pre-pulse laser beam P. As a result, the entire diffused target may be irradiated with the main pulse laser beam M.

Figure 3A:
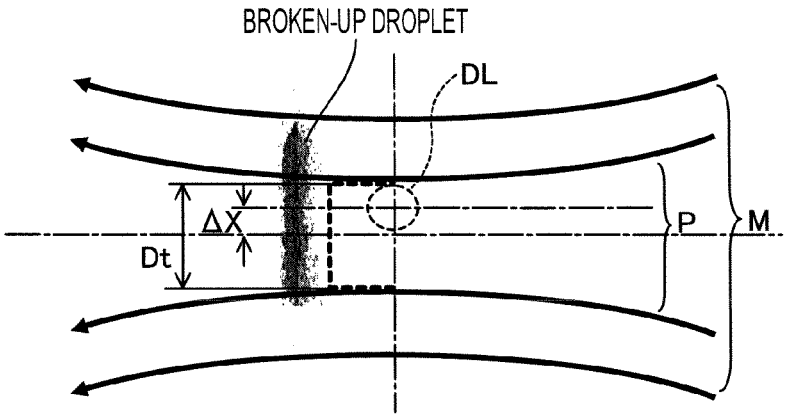
FIGS. 3A through 3C each show another example of a droplet of a target material being irradiated with a pre-pulse laser beam in this disclosure.
Figure 3B:
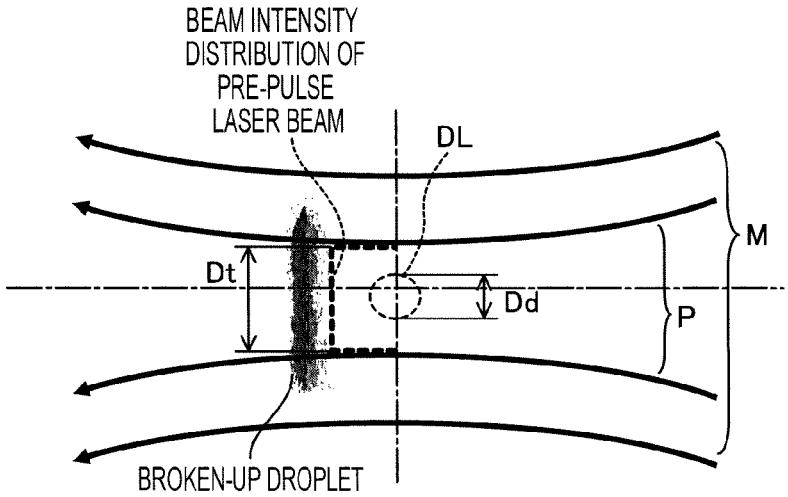
Figure 3C:
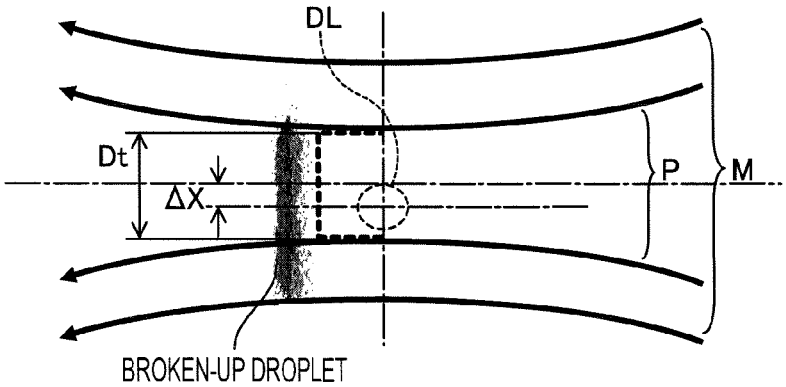

FIGS. 3A through 3C each show another example of a droplet of a target material irradiated with a pre-pulse laser beam in this disclosure. In the cases shown in FIGS. 3A through 3C, as in the cases shown in FIGS. 2A through 2C, the pre-pulse laser beam P may have such a beam intensity distribution that includes the region (diameter Dt) where the beam intensity along the cross-section of the pre-pulse laser beam P has substantial uniformity.

In the cases shown in FIGS. 3A through 3C, the droplet DL, when irradiated with the pre-pulse laser beam P, may be broken up and diffused in a disc-shape to form a diffused target. Such a diffused target may be obtained under the condition where the droplet DL is a mass-limited droplet (approximately 10 μm in diameter) and the beam intensity of the pre-pulse laser beam P is controlled to substantial intensity, which will be described later.

In the cases shown in FIGS. 3A through 3C, even when the position of the droplet DL relative to beam axis of the pre-pulse laser beam P varies, the droplet DL may be located within the region (diameter Dt) where the beam intensity along the cross-section of the pre-pulse laser beam P has substantial uniformity. Thus, the droplet DL may be irradiated with the pre-pulse laser beam P at substantially uniform beam intensity across the irradiation surface of the droplet DL. Accordingly, even when the position of the droplet DL relative to the beam axis of the pre-pulse laser beam P varies when the droplet DL is irradiated with the pre-pulse laser beam P, the target material forming the droplet DL may be diffused in a direction perpendicular to the beam axis of the pre-pulse laser beam P. As a result, the entire diffused target may be irradiated with the main pulse laser beam M.

3. Diameter Of Region Of Substantial Uniformity

With reference to FIGS. 2A through 3C, the diameter Dt of the region where the beam intensity along the cross-section of the pre-pulse laser beam P has substantial uniformity will now be discussed.

In order to diffuse a target in the direction perpendicular to the beam axis of the pre-pulse laser beam P when the droplet DL is irradiated with the pre-pulse laser beam P, the droplet DL may preferably be irradiated with the pre-pulse laser beam P with substantially uniform beam intensity across a hemispherical surface thereof. Accordingly, when the diameter of the droplet DL is Dd, the diameter Dt of the aforementioned region may preferably be larger than the diameter Dd.

Further, when the position of the droplet DL relative to the beam axis of the pre-pulse laser beam P when the droplet DL is irradiated with the pre-pulse laser beam P may vary, a possible variation ΔX (see FIGS. 3A and 3C) may preferably be taken into consideration. For example, the diameter Dt of the aforementioned region may preferably satisfy the following condition.

$$Dt \geq Dd + 2\Delta X$$

That is, the diameter Dt of the aforementioned region may preferably be equal to or larger than the sum of the diameter Dd of the droplet DL and the variation ΔX in the position of the droplet DL. Here, the position of the droplet DL is assumed to vary in opposite directions along a plane perpendicular to the beam axis. Thus, double the variation ΔX (2ΔX) is added to the diameter Dd of the droplet DL.

FIG. 4A shows the relationship between a diameter of a droplet and a diameter of a pre-pulse laser beam, as viewed in the direction of the beam axis. FIG. 4B also shows the relationship between a diameter of a diffused target and a diameter of a main pulse laser beam, as viewed in the direction of the beam axis. As shown in FIG. 4A, the diameter Dt of the aforementioned region may preferably be equal to or larger than the sum of the diameter Dd and 2ΔX. Further, as shown in FIG. 4B, in order for the entire diffused target to be irradiated with the main pulse laser beam M, a beam diameter Dm of the main pulse laser beam M may preferably be equal to or larger than a diameter De of the diffused target.

Further, when the droplet DL is irradiated with the pre-pulse laser beam P having such a beam intensity distribution that includes a region where the beam intensity along a cross-section of the pre-pulse laser beam P has substantial uniformity, the droplet DL may be diffused in the direction perpendicular to the beam axis of the pre-pulse laser beam P. Thus, the variation in the position of the diffused target does not depend on the direction into which the droplet is diffused, but may depend primarily on the already-existing variation ΔX in the position of the droplet DL when the droplet DL is irradiated with the pre-pulse laser beam P. Accordingly, the beam diameter Dm of the main pulse laser beam M may preferably satisfy the following condition.

$$Dm \geq De + 2\Delta X$$

That is, the beam diameter Dm of the main pulse laser beam M may preferably be equal to or larger than the sum of the diameter De of the diffused target and the variation ΔX in the position of the droplet DL. Here, the position of the droplet DL is assumed to vary in opposite directions along a plane perpendicular to the beam axis. Thus, double the variation ΔX (2ΔX) is added to the diameter De of the diffused target.

FIG. 5 is a table showing examples of the variation ΔX in the position of the droplet DL. When the standard deviation of the distance between the beam axis of the pre-pulse laser beam P and the center of the droplet DL along the plane perpendicular to the beam axis is σ, ΔX may be set to σ, 2σ, 3σ, . . . , for example.

Here, under the assumption that the distance between the beam axis of the pre-pulse laser beam P and the center of the droplet DL is in the normal distribution, under the condition of Dt≥Dd+2ΔX, the probability of the droplet DL irradiated (or not irradiated) with the pre-pulse laser beam P such that the droplet DL is located within a region where the beam intensity distribution along the cross-section of the pre-pulse laser beam P has substantial uniformity may be calculated.

In the table shown in FIG. 5, the probability of the droplet DL not being irradiated with the pre-pulse laser beam P such that the droplet DL is located within the aforementioned region is shown in the right column. As shown in FIG. 5, the aforementioned probability is 15.9% when the variation ΔX is σ, 2.28% when the variation ΔX is 2σ, and 0.135% when the variation ΔX is 3σ.

Although a case where each of the pre-pulse laser beam P and the main pulse laser beam M has a circular cross-section and each of the droplet DL and the diffused target has a circular cross-section has been described so far, this disclosure is not limited thereto. When the cross-section is not circular, the relationship between the spot size of a given laser beam and the size of a droplet may be defined two-dimensionally in terms of the area. For example, an area (mathematical) of a region (two-dimensional plane) where the beam intensity distribution along the cross-section of the pre-pulse laser beam P has substantial uniformity may exceed the area (mathematical) of the maximum cross-section of the droplet DL. Further, the minimum area of the region where the beam intensity distribution along the cross-section of the pre-pulse laser beam P has substantial uniformity may be equal to or larger than the sum of the area of the maximum cross-section of the droplet DL and the variation in the position of the droplet DL. Furthermore, an area of the cross-section of the main pulse laser beam M may be larger than the area of the maximum cross-section of the diffused target. In addition, the area of the minimum cross-section of the main pulse laser beam M may be equal to or larger than the sum of the area of the maximum cross-section of the diffused target and the variation in the position of the diffused target.

Figure 6:
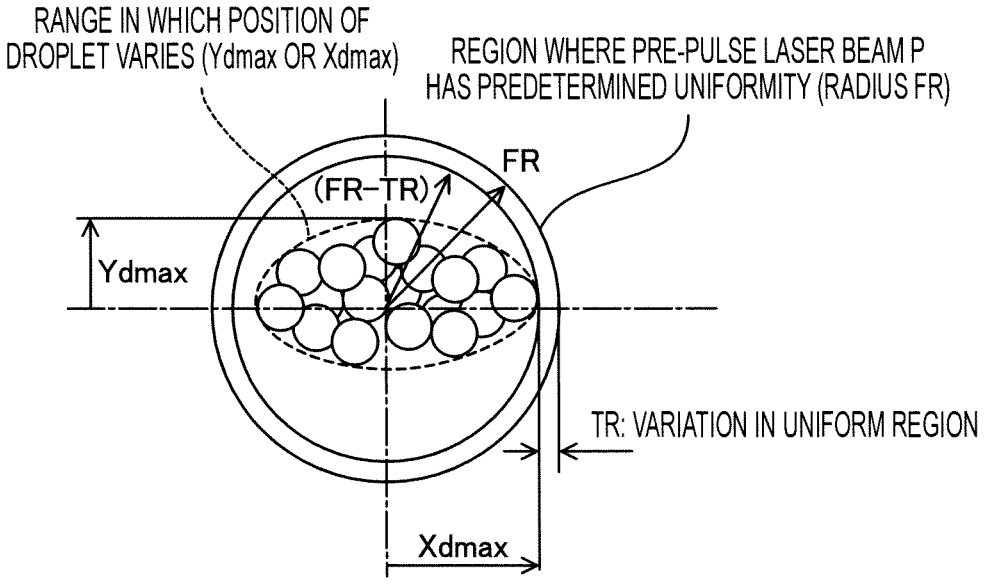
FIG. 6 shows the relationship between a range within which the position of a droplet varies and a diameter of a pre-pulse laser beam, as viewed in the direction of the beam axis.

FIG. 6 shows the relationship between a range within which the position of the droplet DL may vary and the diameter of the pre-pulse laser beam P, as viewed in the direction of the beam axis. As shown in FIG. 6, the variation in the position of the droplet DL along the plane perpendicular to the beam axis of the pre-pulse laser beam P may be evaluated in various directions. In FIG. 6, Xdmax is the sum of the radius of a droplet DL and the maximum amount (distance) in which the center position of the droplet DL varies in the X-direction from a plane containing the beam axis of the pre-pulse laser beam P, the plane extending in the Y-direction, and Ydmax is the sum of the radius of a droplet DL and the maximum amount (distance) in which the center position of the droplet DL varies in the Y-direction from a plane containing the beam axis of the pre-pulse laser beam P, the plane extending in the X-direction. In the example shown in FIG. 6, the maximum value of the variation along the X-direction is greater than the maximum value of the variation along the Y-direction (Xdmax>Ydmax).

In that case, the size of the cross-section (the substantially uniform intensity distribution region) of the pre-pulse laser beam P may be determined in consideration of the variation along the X-direction. For example, the size of the pre-pulse laser beam P may be determined such that a region where the beam intensity distribution along the cross-section of the pre-pulse laser beam P has substantial uniformity may have a circular shape with a diameter FR equal to or greater than Xdmax. Alternatively, the pre-pulse laser beam P may be shaped such that the substantially uniform intensity distribution region has an elliptical or any other suitable shape with the dimension in the X-direction equal to or greater than Xdmax. Further, considering that there may be a variation TR in the size of the substantially uniform intensity distribution region, the region may have any suitable shape where the dimension in the X-direction is equal to or greater than (Xdmax+TR).

Further, the diameter of the pre-pulse laser beam P may be adjustable in accordance with the variation in the position of the droplet DL. When the diameter of the pre-pulse laser beam P is changed while the energy of the pre-pulse laser beam P is retained constant, the beam intensity of the pre-pulse laser beam P along the irradiation plane varies inversely to the square of the beam diameter. Accordingly, the energy of the pre-pulse laser beam P may be adjusted in order to retain the beam intensity constant.

Alternatively, the shape of the substantially uniform intensity distribution region where the beam intensity distribution along the cross-section of the pre-pulse laser beam P has substantial uniformity may be adjusted to be elliptical if, for example, the dimension in the X-direction (Xdmax+TR) is greater than the dimension in the Y-direction (Ydmax+TR). As for the main pulse laser beam M, the size or the shape of the cross-section thereof may be adjusted in accordance with the variation in the position of the diffused target along the X-direction and the Y-direction.

4. Examples Of Beam Intensity Distribution

Figure 7A:
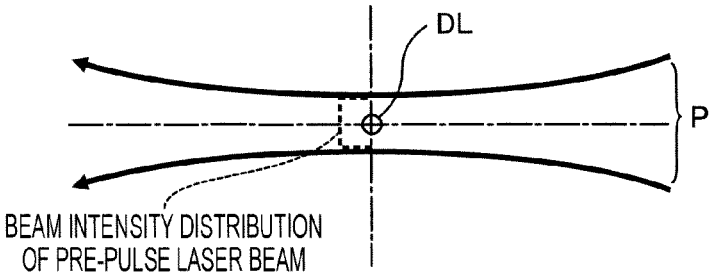
FIGS. 7A through 7C are diagrams for discussing examples of a beam intensity distribution of the pre-pulse laser beam in this disclosure.
Figure 7B:
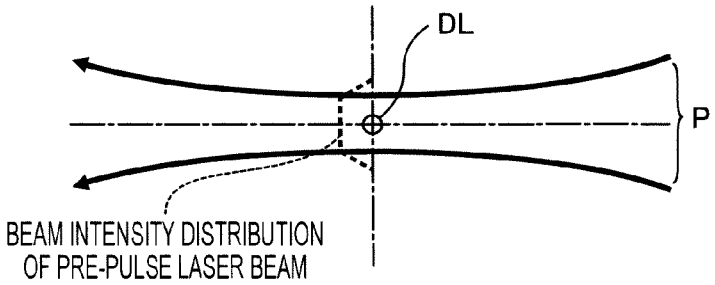
Figure 7C:
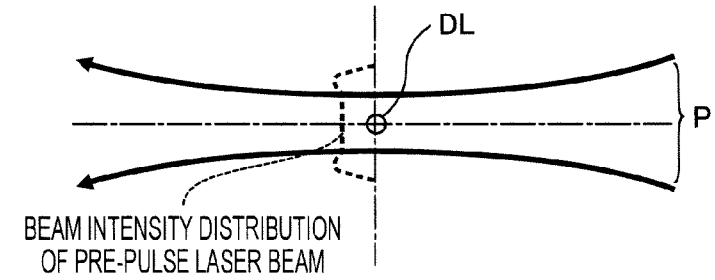

FIGS. 7A through 7C are diagrams for discussing examples of the beam intensity distribution of the pre-pulse laser beam in this disclosure. As shown in FIG. 7A, when the pre-pulse laser beam P has a substantially uniform beam intensity distribution across the cross-section, the beam intensity distribution of such pre-pulse laser beam P may be a top-hat distribution and can be considered to have the substantial uniformity.

As shown in FIG. 7B, even when the pre-pulse laser beam P has a beam intensity distribution along the cross-section where the beam intensity gradually decreases around the peripheral region, when the center portion surrounded by such peripheral region has a substantially uniform beam intensity distribution, the center portion can be said to have the substantial uniformity.

As shown in FIG. 7C, even when the pre-pulse laser beam P has a beam intensity distribution along the cross-section where the beam intensity is higher around the peripheral region, when the center portion surrounded by such peripheral region has a substantially uniform beam intensity distribution, the center portion can be said to have the substantial uniformity.

In order to diffuse the droplet DL in the direction perpendicular to the beam axis of the pre-pulse laser beam P when the droplet DL is irradiated with the pre-pulse laser beam P, the pre-pulse laser beam P may preferably include the substantially uniform beam intensity distributed center portion, as shown in FIGS. 7A through 7C. However, as will be described below, the beam intensity distribution of a given laser beam does not need to be perfectly uniform. It is sufficient as long as the above-discussed region (e.g., FIGS. 4A and 4B) of the cross-section of the given laser beam has a certain uniformity.

Figure 8:
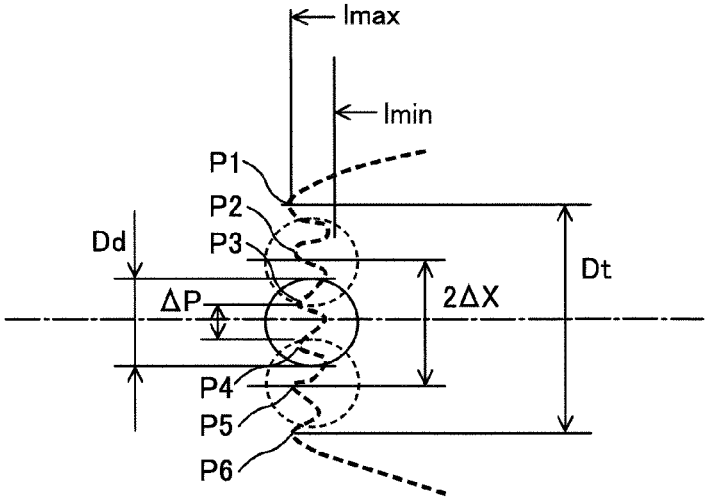
FIG. 8 is a diagram for discussing a beam intensity distribution of a laser beam with which a target material is irradiated.

FIG. 8 is a diagram for discussing the beam intensity distribution of a laser beam with which a target material is irradiated. As shown in FIG. 8, the laser beam may not be said to have the substantial uniformity in a given region (diameter Dt) along its cross-section depending on a difference between a value Imax and a value Imin. The value Imax is the highest beam intensity in the given region and the value Imin is the lowest beam intensity in the given region. In order for a laser beam to be consider to have the substantial uniformity in a give region along its cross-section, for example, the value of a variation C below may be equal to or smaller than 20(%).

$$C=\{(I\max-I\min)/(I\max+I\min)\}\times 100(\%)$$

The value of the variation C equal to or smaller than, for example, 10(%) may be considered to be preferable than 20%

Further, when there are multiple peaks P1 through P6 existing within the region, a gap ΔP between two adjacent peaks may be equal to or smaller than, for example, one half of the diameter Dd of the droplet DL to say that the pre-pulse laser beam P has the substantially uniform beam intensity distribution.

5. First Embodiment

Figure 9:
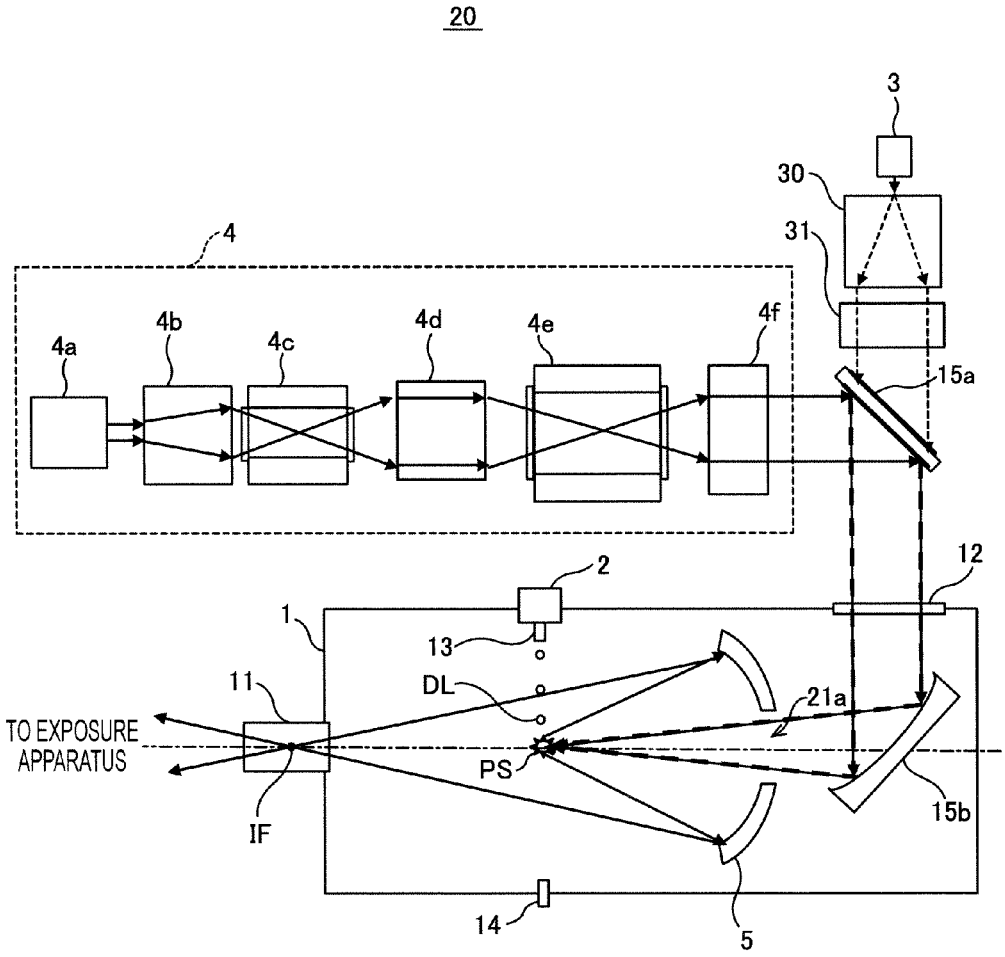
FIG. 9 schematically illustrates an exemplary configuration of an EUV light generation system according to a first embodiment.

FIG. 9 schematically illustrates an exemplary configuration of an EUV light generation system according to a first embodiment. The EUV light generation system of the first embodiment may be of an LPP type. As shown in FIG. 9, an EUV light generation system 20 may include a chamber 1, a target supply unit 2, a pre-pulse laser apparatus 3, a main pulse laser apparatus 4, and an EUV collector mirror 5.

The chamber 1 may be a vacuum chamber in which the EUV light is generated. The chamber 1 may be provided with an exposure apparatus connection port 11 and a window 12. The EUV light generated inside the chamber 1 may be outputted to an external apparatus, such as an exposure apparatus (reduced projection reflective optical system), through the exposure apparatus connection port 11. The laser beams outputted from the pre-pulse laser apparatus 3 and the main pulse laser apparatus 4, respectively, may enter the chamber 1 through the window 12.

The target supply unit 2 may be configured to supply a target material, such as tin (Sn) or lithium (Li) for generating the EUV light, into the chamber 1. The target material may be outputted through a target nozzle 13 in the form of droplets DL. The diameter of the droplet DL may be in the range between 10 μm and 100 μm. Of the droplets DL supplied into the chamber 1, those that are not irradiated with a laser beam may be collected into a target collector 14.

Each of the pre-pulse laser apparatus 3 and the main pulse laser apparatus 4 may be a master oscillator power amplifier (MOPA) type laser apparatus configured to output a driving laser beam for exciting the target material. The pre-pulse laser apparatus 3 and the main pulse laser apparatus 4 may each be configured to output a pulse laser beam (e.g., a pulse duration of a few to several tens of nanoseconds) at a high repetition rate (e.g., 10 to 100 kHz). The pre-pulse laser apparatus 3 may be configured to output the pre-pulse laser beam P at a first wavelength, and the main pulse laser apparatus 4 may be configured to output the main pulse laser beam M at a second wavelength. A Yttrium Aluminum Garnet (YAG) laser apparatus may be used as the pre-pulse laser apparatus 3, and a $CO_2$ laser apparatus may be used as the main pulse laser apparatus 4. However, this disclosure is not limited thereto, and any other suitable laser apparatuses may be used.

The pre-pulse laser beam P from the pre-pulse laser apparatus 3 may be transmitted through a beam combiner 15*a* and through the window 12, and be reflected by a laser beam focusing optical system, such as an off-axis paraboloidal mirror 15*b*. Then, the pre-pulse laser beam P may pass through a through-hole 21*a* formed in the EUV collector mirror 5, and be focused on the droplet DL in the plasma generation region PS. When the droplet DL is irradiated with the pre-pulse laser beam P, the droplet DL may be turned into a diffused target.

The main pulse laser beam M from the main pulse laser apparatus 4 may be reflected by the beam combiner 15*a*, transmitted through the window 12, and reflected by the off-axis paraboloidal mirror 15*b*. Then, the main pulse laser beam M may pass through the through-hole 21*a*, and be focused on the diffused target in the plasma generation region PS. When the diffused target is irradiated with the main pulse laser beam M, the diffused target may be excited by the energy of the main pulse laser beam M. Accordingly, the diffused target may be turned into plasma, and rays of light at various wavelengths including the EUV light may be emitted from the plasma.

The EUV collector mirror 5 may have a spheroidal concave surface on which a multilayer reflective film formed by alternately laminating a molybdenum (Mo) layer and a silicon (Si) layer is formed to selectively collect and reflect the EUV light at a central wavelength of 13.5 nm. The EUV collector mirror 5 may be positioned so that a first focus of the spheroidal surface lies in the plasma generation region PS and a second focus thereof lies in an intermediate focus region IF. Because of such an arrangement, the EUV light reflected by the EUV collector mirror 5 may be focused in the intermediate focus region IF and then be outputted to an external exposure apparatus.

A beam-shaping optical system 31 may be configured to adjust the beam intensity distribution of the pre-pulse laser beam P with which the droplet DL is to be irradiated. The pre-pulse laser beam P from the pre-pulse laser apparatus 3 may first be expanded in diameter by a beam expander 30 and then enter the beam-shaping optical system 31. The beam-shaping optical system 31 may adjust the beam intensity distribution of the pre-pulse laser beam P such that the pre-pulse laser beam P contains a region where the beam intensity distribution along a cross-section of the pre-pulse laser beam P has substantial uniformity at a position where the droplet DL is irradiated therewith and such that the diameter Dt of the aforementioned region is greater than the diameter Dd of the droplet DL (see, e.g., FIG. 4A). The pre-pulse laser beam P outputted from the beam-shaping optical system 31 is incident on the beam combiner 15*a*.

The main pulse laser apparatus 4 may include a master oscillator 4*a*, a preamplifier 4*c*, a main amplifier 4*e*, and relay optical systems 4*b*, 4*d*, and 4*f* respectively disposed downstream from the master oscillator 4*a*, the preamplifier 4*c*, and the main amplifier 4*e*. The master oscillator 4*a* may be configured to output a seed beam at the second wavelength. The seed beam from the master oscillator 4*a* may be amplified by the preamplifier 4*c* and the main amplifier 4*e* to have a desired beam intensity. The amplified seed beam is outputted from the main pulse laser apparatus 4 as the main pulse laser beam M, and the main pulse laser beam M is then incident on the beam combiner 15*a*.

The beam combiner 15*a* may be configured to transmit the pre-pulse laser beam P outputted from the pre-pulse laser apparatus 3 at the first wavelength (e.g., 1.06 μm) with high transmittance and to reflect the main pulse laser beam M outputted from the main pulse laser apparatus 4 at the second wavelength (10.6 μm) with high reflectance. The beam combiner 15*a* may be positioned such that the transmitted pre-pulse laser beam P and the reflected main pulse laser beam M may travel in substantially the same direction into the chamber 1. More specifically, the beam combiner 15*a* may include a diamond substrate on which a multilayer film having the aforementioned reflection/transmission properties is formed. Alternatively, the beam combiner 15*a* may be configured to reflect the pre-pulse laser beam P with high reflectivity and to transmit the main pulse laser beam M with high transmittance. To use such a beam combiner, the place of the pre-pulse laser apparatus 3 and that of the main pulse laser apparatus 4 with respect to the beam combiner 15*a* may be switched.

According to the first embodiment, the pre-pulse laser beam P may contain a region where the beam intensity distribution along a cross-section thereof has substantial uniformity at a position where the droplet DL is irradiated therewith, and the diameter Dt of such a region is greater than the diameter Dd of the droplet DL. Accordingly, the variation in the position of the diffused target resulting from the variation in the position of the droplet DL may be reduced. In turn, the entire diffused target may be irradiated with the main pulse laser beam M, and consequently, the stability in the energy of the generated EUV light may be improved.

Further, according to the first embodiment, the pre-pulse laser beam P and the main pulse laser beam M may be guided to the plasma generation region PS along substantially the same beam path. Accordingly, separate through-holes for the pre-pulse laser beam P and the main pulse laser beam M respectively need not be formed in the EUV collector mirror 5.

In the first embodiment, the EUV light generation system 20 that includes the pre-pulse laser apparatus 3 and the main pulse laser apparatus 4 is described. This disclosure, however, is not limited thereto. For example, the embodiment(s) of this disclosure may be applied to a chamber apparatus used with an external laser apparatus configured to supply excitation energy into the chamber apparatus for generating the EUV light.

6. Examples Of Beam-Shaping Optical Systems

Figure 10:
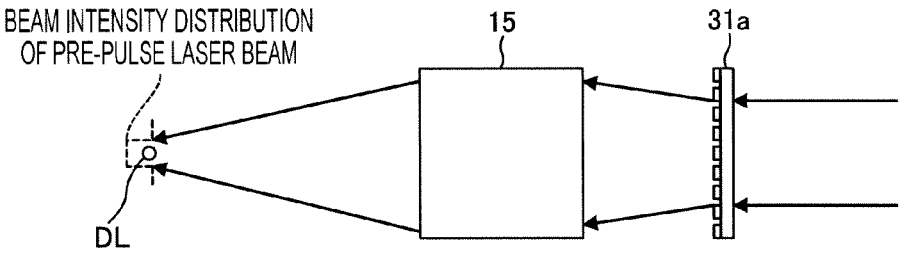
FIG. 10 is a conceptual diagram showing an example of a beam-shaping optical system.

FIG. 10 is a conceptual diagram showing an example of a beam-shaping optical system. The beam-shaping optical system shown in FIG. 10 may include a diffractive optical element 31*a*. The diffractive optical element 31*a* may comprise a transparent substrate on which minute concavities and convexities for diffracting an incident laser beam are formed. The concavity/convexity pattern on the diffractive optical element 31*a* may be designed such that the diffracted laser beam, when focused by a focusing optical system, forms a spot having substantially uniform beam intensity distribution across its cross-section. The diffracted laser beam outputted from the diffractive optical element 31*a* may be focused by a focusing optical system 15 (e.g., the off-axis paraboloidal mirror 15*b* shown in FIG. 9). As a result, the droplet DL may be irradiated with the pre-pulse laser beam P having a top-hat beam intensity distribution.

Figure 11:
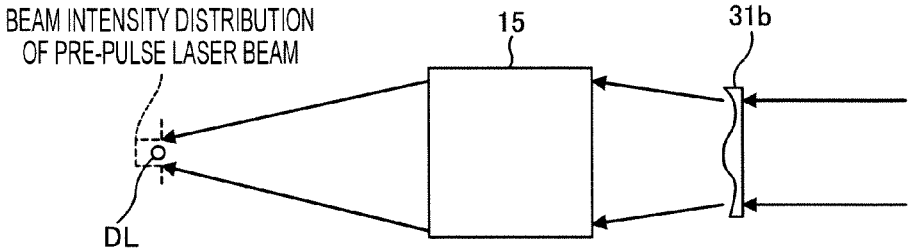
FIG. 11 is a conceptual diagram showing another example of a beam-shaping optical system.

FIG. 11 is a conceptual diagram showing another example of a beam-shaping optical system. The beam-shaping optical system shown in FIG. 11 may include a phase shift optical element 31*b*. The phase shift optical element 31*b* may comprise a transparent substrate which is thicker at the center portion than in the peripheral portion. The phase shift optical element 31*b* may give a phase difference n between a laser beam transmitted through the center portion and a laser beam transmitted through the peripheral portion. Because of the phase optical element 31*b*, an incident laser beam having the Gaussian beam intensity distribution may be converted into such a laser beam that, when focused by the focusing optical system 15, forms a spot having a top-hat beam intensity distribution across its cross-section, and outputted from the phase shift optical element 31*b*.

Figure 12:
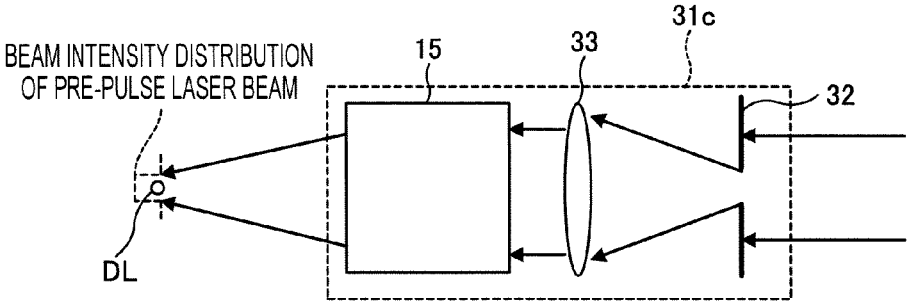
FIG. 12 is a conceptual diagram showing yet another example of a beam-shaping optical system.

FIG. 12 is a conceptual diagram showing yet another example of a beam-shaping optical system. The beam-shaping optical system shown in FIG. 12 may include a mask 32 having an opening of any shape formed therein. The mask 32, a collimator lens 33, and the focusing optical system 15 may constitute a reduced projection optical system 31*c*. The mask 32 may allow a portion of an incident pre-pulse laser beam P where a beam intensity distribution has substantial uniformity to pass therethrough. The reduced projection optical system 31*c* may be configured to project an image of the pre-pulse laser beam P having passed through the mask 32 on the droplet DL through the collimator lens 33 and the focusing optical system 15. Accordingly, the droplet DL may be irradiated with the pre-pulse laser beam P having a top-hat beam intensity distribution.

Figure 13:
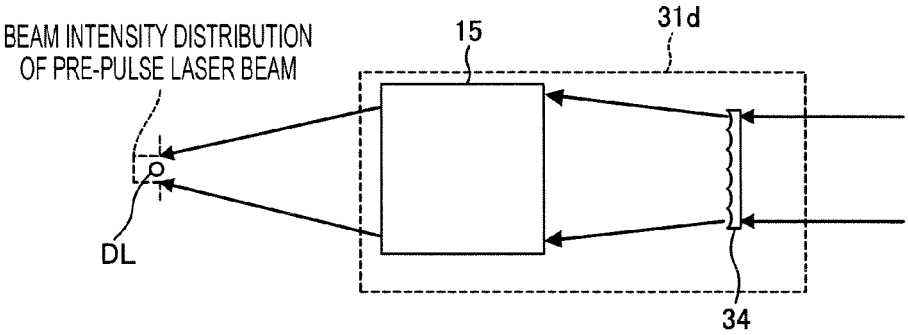
FIG. 13 is a conceptual diagram showing yet another example of a beam-shaping optical system.

FIG. 13 is a conceptual diagram showing yet another example of a beam-shaping optical system. The beam-shaping optical system shown in FIG. 13 may include a fly-eye lens array 34 in which a number of small concave lenses are arranged. The fly-eye lens array 34 and the focusing optical system 15 may constitute a Kohler illumination optical system 31*d*. With the Kohler illumination optical system 31*d*, the incident pre-pulse laser beam P may be diverged at an angle by the respective concave lenses in the fly-eye lens array 34, and the diverged laser beams may overlap with one another at the focus of the focusing optical system 15. As a result, the beam intensity distribution of the pre-pulse laser beam P may become substantially uniform at the focus of the focusing optical system 15. Accordingly, the droplet DL may be irradiated with the pre-pulse laser beam P having a top-hat beam intensity distribution.

In the examples shown in FIGS. 10 through 13, transmissive optical elements are used to adjust the beam intensity distribution of the pre-pulse laser beam P. This disclosure, however, is not limited thereto, and reflective optical elements may be used instead. Further, although each of FIGS. 10 through 13 shows a case where a beam-shaping optical system is combined with a focusing optical system, this disclosure is not limited thereto. A single optical element may be configured to fulfill both functions. For example, an optical element in which minute concavities and convexities as in the diffractive optical element are formed on a focusing lens, or an optical element in which a focusing mirror has the phase shift function may be used.

Figure 14:
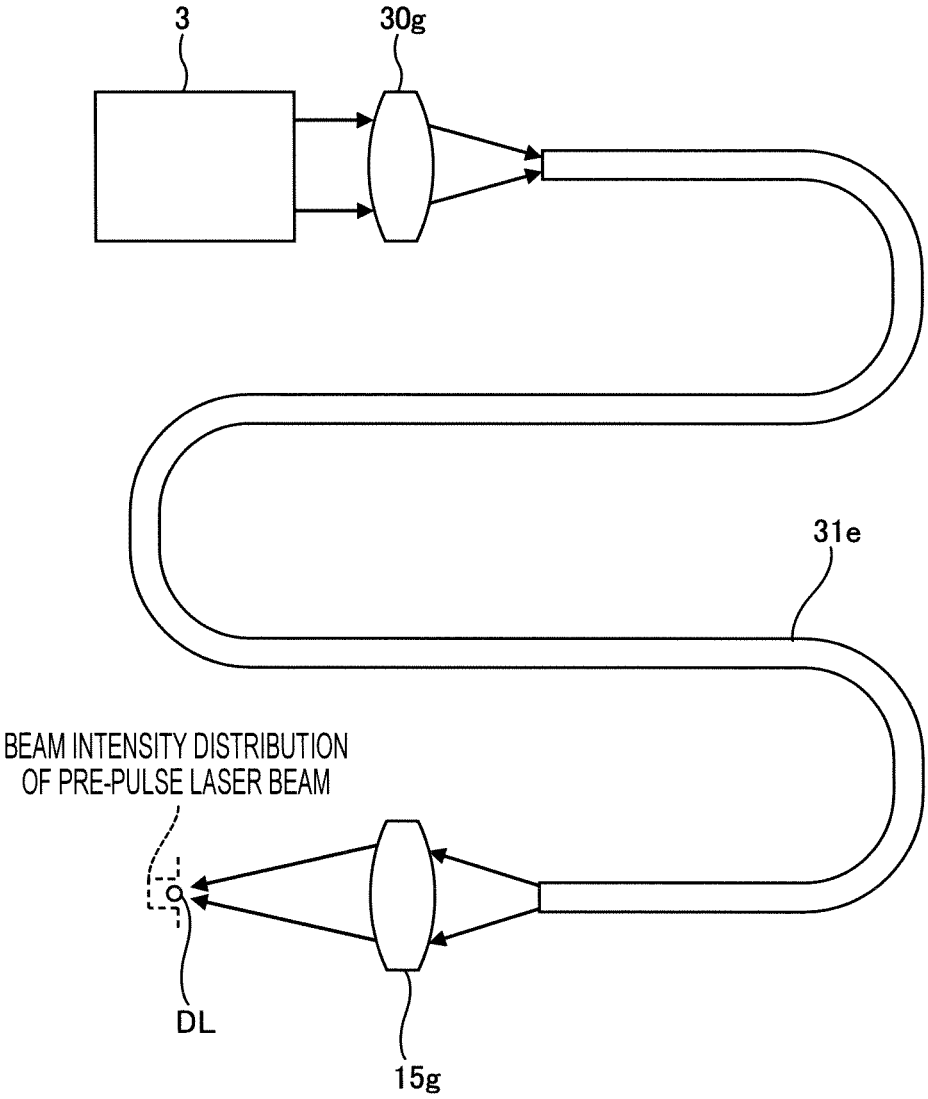
FIG. 14 is a conceptual diagram showing yet another example of a beam-shaping optical system.

FIG. 14 is a conceptual diagram showing yet another example of a beam-shaping optical system. The beam-shaping optical system shown in FIG. 14 may include a multi-mode optical fiber 31*e*. Further, a focusing optical system 30*g*, in place of the beam expander 30 (see FIG. 9), may be provided in a beam path between the pre-pulse laser apparatus 3 and the multi-mode optical fiber 31*e*.

The pre-pulse laser beam P from the pre-pulse laser apparatus 3 may be focused by the focusing optical system 30*g* and may enter the multi-mode optical fiber 31*e*. Preferably, the pre-pulse laser beam P may be focused in accordance with the numerical aperture of the multi-mode optical fiber 31*e*. Generally, the multi-mode optical fiber 31*e* has a larger core than a single-mode optical fiber, and has multiple paths through which the laser beam travels. Accordingly, when the pre-pulse laser beam P having the Gaussian beam intensity distribution passes through the multi-mode optical fiber 31*e*, the beam intensity distribution may change. Thus, the pre-pulse laser beam P having the Gaussian beam intensity distribution may be converted into a laser beam having a top-hat beam intensity distribution. The focusing optical system 15*g* may project an image of the pre-pulse laser beam P from the multi-mode optical fiber 31*e* on the droplet DL so that the droplet DL may be irradiated with the pre-pulse laser beam P having a top-hat beam intensity distribution.

7. Second Embodiment

Figure 15:
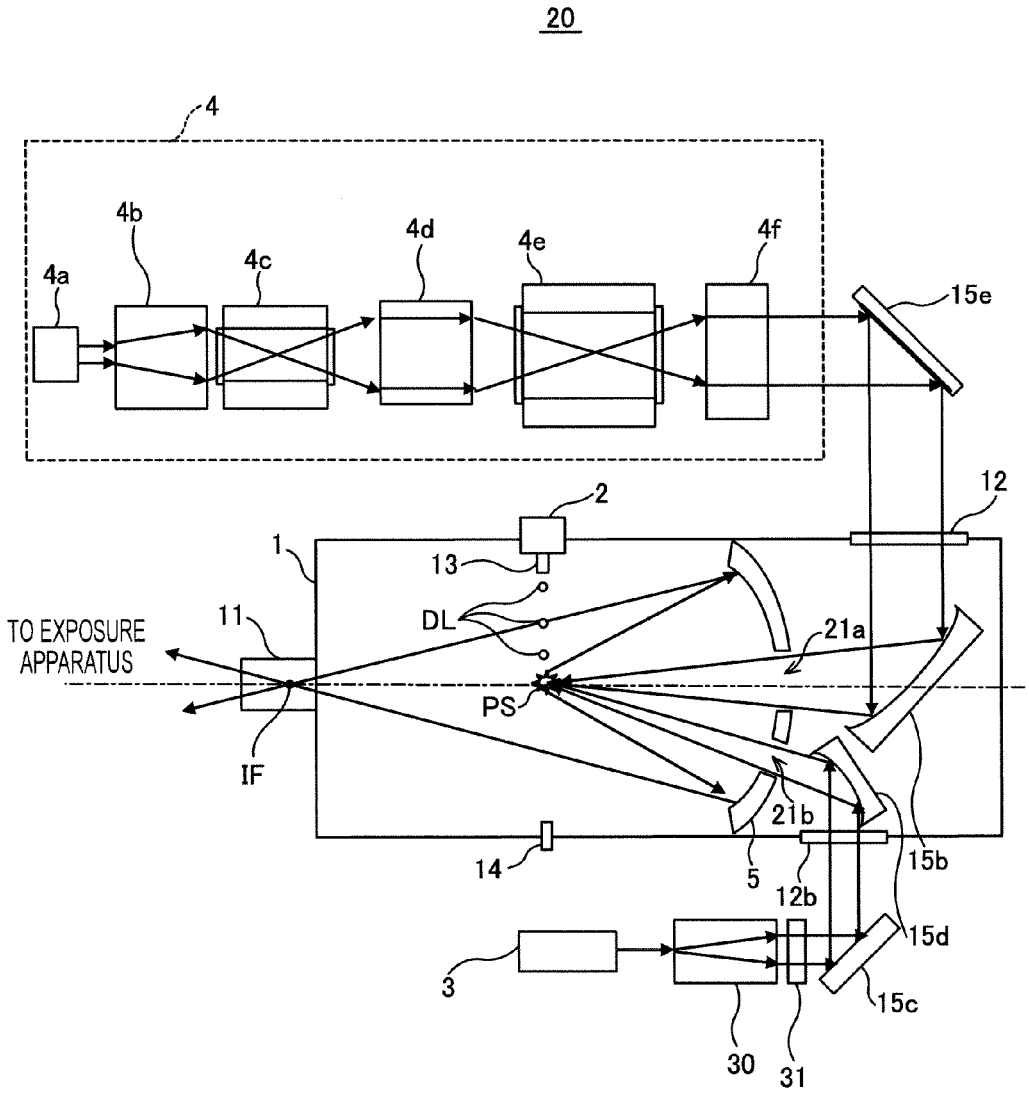
FIG. 15 schematically illustrates an exemplary configuration of an EUV light generation system according to a second embodiment.

FIG. 15 schematically illustrates an exemplary configuration of an EUV light generation system according to a second embodiment. In the EUV light generation system according to the second embodiment, the pre-pulse laser beam P from the pre-pulse laser apparatus 3 and the main pulse laser beam M from the main pulse laser apparatus 4 may be guided into the chamber 1 along separate beam paths.

The pre-pulse laser beam P from the pre-pulse laser apparatus 3 may be reflected by a high-reflection mirror 15*c*, transmitted through a window 12*b*, and reflected by an off-axis paraboloidal mirror 15*d*. Then the pre-pulse laser beam P may be focused on the droplet DL in the plasma generation region PS through a through-hole 21*b* formed in the EUV collector mirror 5. When the droplet DL is irradiated with the pre-pulse laser beam P, the droplet DL may be turned into a diffused target.

The main pulse laser beam M from the main pulse laser apparatus 4 may be reflected by a high-reflection mirror 15*e*, transmitted through the window 12, and reflected by the off-axis paraboloidal mirror 15*b*. Then, the main pulse laser beam M may be focused on the diffused target in the plasma generation region PS through the through-hole 21*a* formed in the EUV collector mirror 5.

According to the second embodiment, the pre-pulse laser beam P and the main pulse laser beam M may respectively be guided to the plasma generation region PS through separate optical systems. Accordingly, each optical system may be designed independently of one another such that each of the pre-pulse laser beam P and the main pulse laser beam M forms a spot of a desired size. Further, the droplet DL and the diffused target may respectively be irradiated with the pre-pulse laser beam P and the main pulse laser beam M in substantially the same direction without an optical element, such as a beam combiner which makes the beam paths of the pre-pulse laser beam P and the main pulse laser beam M coincide with each other.

8. Third Embodiment

Figure 16:
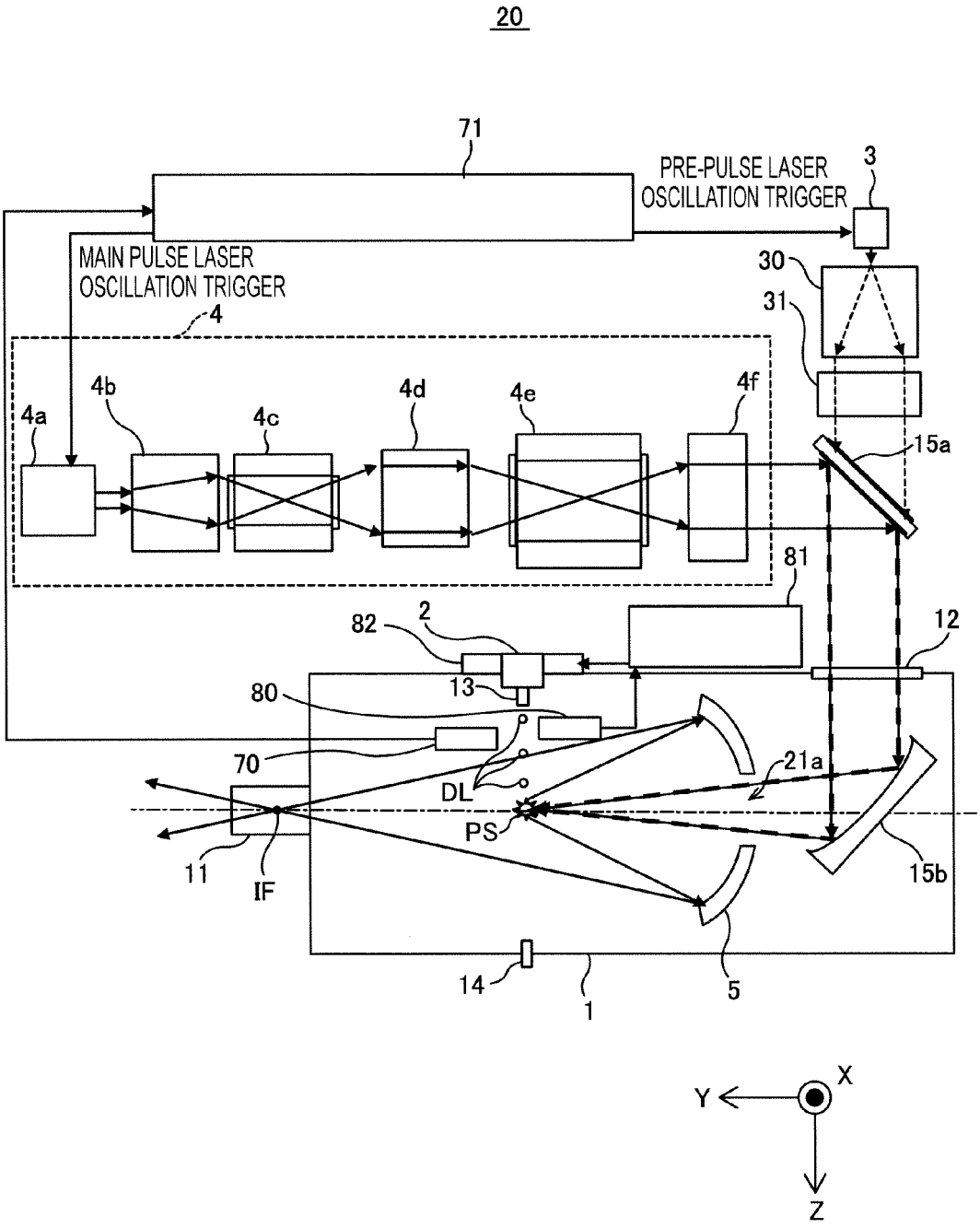
FIG. 16 schematically illustrates an exemplary configuration of an EUV light generation system according to a third embodiment.

FIG. 16 schematically illustrates an exemplary configuration of an EUV light generation system according to a third embodiment. In the EUV light generation system according to the third embodiment, a position detection mechanism for detecting the droplet DL may be added to the EUV light generation system according to the first embodiment shown in FIG. 9. Because of the position detection mechanism, a timing at which a laser beam is outputted may be controlled in accordance with the detection result by the position detection mechanism. The position detection mechanism may include a droplet Z-direction detector 70 and a droplet XY-direction detector 80.

The droplet Z-direction detector 70 may be configured to detect the position of the droplet DL in the travel direction thereof (Z-direction). More specifically, the droplet Z-direction detector 70 may send a Z-position detection signal to a laser trigger generation mechanism (laser controller) 71 when the droplet DL reaches a position in the Z-direction.

Upon receiving the Z-position detection signal, the laser trigger generation mechanism 71 may send a pre-pulse laser oscillation trigger signal to the pre-pulse laser apparatus 3 when a first delay time elapses. The pre-pulse laser apparatus 3 may output the pre-pulse laser beam P based on the pre-pulse laser oscillation trigger signal. The first delay time may be set appropriately so that the pre-pulse laser beam P from the pre-pulse laser apparatus 3 strikes the droplet DL in the plasma generation region PS.

With the above control, the droplet DL may be irradiated with the pre-pulse laser beam P in the plasma generation region PS and turned into a diffused target. Thereafter, the laser trigger generation mechanism 71 may send a main pulse laser oscillation trigger signal to the main pulse laser apparatus 4 when a second delay time elapses. The main pulse laser apparatus 4 may output the main pulse laser beam M based on the main pulse laser oscillation trigger signal. The second delay time may be set such that the diffused target is irradiated with the main pulse laser beam M from the main pulse laser apparatus 4 at a timing at which the diffused target is diffused to a desired size.

In this way, the timing at which the pre-pulse laser beam P is outputted and the timing at which the main pulse laser beam M is outputted may be controlled based on the detection result of the droplet Z-direction detector 70.

Various jitters (temporal fluctuations) may exist among the droplet Z-direction detector 70, the laser trigger generation mechanism 71, the pre-pulse laser apparatus 3, and the main pulse laser apparatus 4. The jitters may include: (1) a jitter in time required for the droplet Z-direction detector 70 to output a signal (σa); (2) a jitter in time required to transmit various signals (σb); (3) a jitter in time required to process various signals (σc); (4) a jitter in time required for the pre-pulse laser apparatus 3 to output the pre-pulse laser beam P (σd); and (5) a jitter in time required for the main pulse laser apparatus 4 to output the main pulse laser beam M (σf). The standard deviation σj of the above jitters may be expressed in the expression below.

$$\sigma j=(\sigma a^2+\sigma b^2+\sigma c^2+\sigma d^2+\sigma f^2+\ldots)^{1/2}$$

The deviation in the Z-direction between the focus of the pre-pulse laser beam P and the position of the droplet DL may, for example, be expressed as 2σj×v, where v is the speed of the droplet DL. In that case, a diameter Dtz of a region where the beam intensity distribution along a cross-section of the pre-pulse laser beam P has substantial uniformity may preferably satisfy the following condition.

$$Dtz \geq Dd+2\sigma j\times v$$

The droplet XY-direction detector 80 may be configured to detect the position of the droplet DL along a plane perpendicular to the travel direction (Z-direction) of the droplet DL, and send an XY-position detection signal to a droplet XY controller 81.

Upon receiving the XY-position detection signal, the droplet XY controller 81 may determine whether or not the position of the detected droplet DL falls within a permissible range. When the position of the droplet DL does not fall within the permissible range, the droplet XY controller 81 may send an XY driving signal to a droplet XY control mechanism 82.

The droplet XY control mechanism 82 may drive a driving motor provided in the target supply unit 2 based on the received XY driving signal. With this, the position toward which the droplet DL is outputted may be controlled. In this way, the position of the droplet DL along the XY plane may be controlled in accordance with the detection result of the droplet XY-direction detector 80.

Even with the above control, may be difficult to change the position toward which the droplet DL is outputted for each droplet DL. Accordingly, when the short-term fluctuation (standard deviation) in the XY-direction is Gx, a diameter Dtx of a region where the beam intensity distribution along a cross-section of the pre-pulse laser beam P has substantial uniformity may preferably satisfy the following condition.

$$Dtx \geq Dd+2\sigma x$$

In the third embodiment, the position toward which the droplet DL is outputted is controlled along the XY plane. This disclosure, however, is not limited thereto. For example, the angle at which the droplet DL is outputted from the target supply unit 2 may be controlled.

9. Fourth Embodiment

Figure 17:
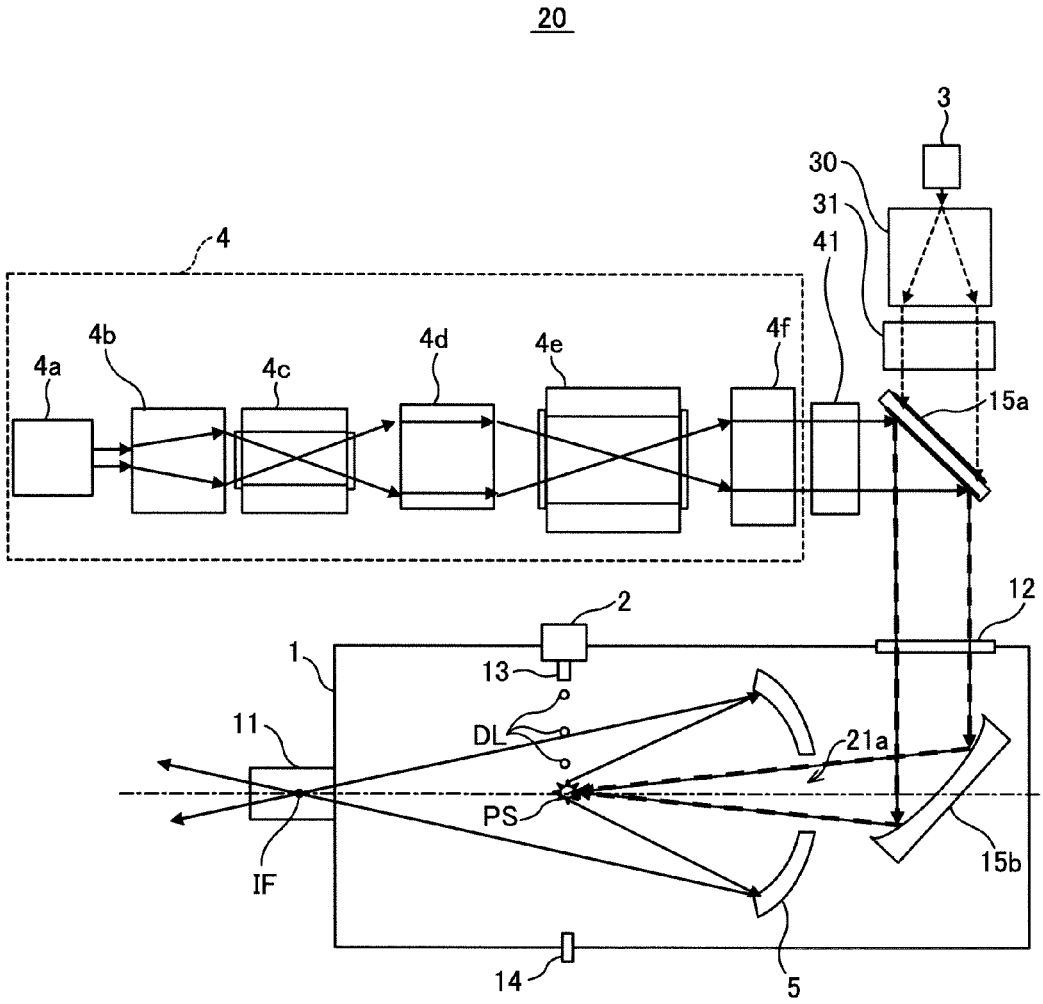
FIG. 17 schematically illustrates an exemplary configuration of an EUV light generation system according to a fourth embodiment.

FIG. 17 schematically illustrates the configuration of an EUV light generation system according to a fourth embodiment. The EUV light generation system according to the fourth embodiment may include a beam-shaping optical system 41 provided between the main pulse laser apparatus 4 and the beam combiner 15*a* to adjust the beam intensity distribution of the main pulse laser beam M.

The configuration of the beam-shaping optical system 41 may be similar to that of the beam-shaping optical system 31 configured to adjust the beam intensity distribution of the pre-pulse laser beam P. The beam-shaping optical system 41 may adjust the beam intensity distribution of the main pulse laser beam M such that the main pulse laser beam M contains a region where the beam intensity distribution along a cross-section has substantial uniformity. With this, the entire diffused target may be irradiated with the main pulse laser beam M at substantially uniform beam intensity.

Figure 18A:
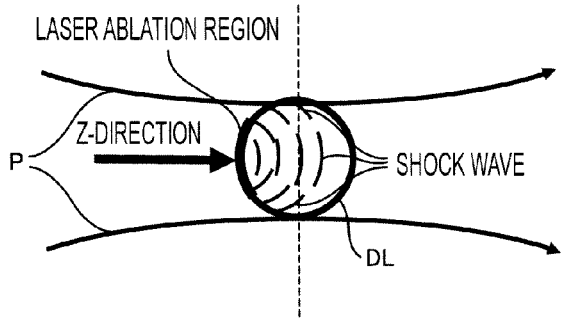
FIG. 18A is a conceptual diagram showing a droplet being irradiated with a pre-pulse laser beam.
Figure 18B:
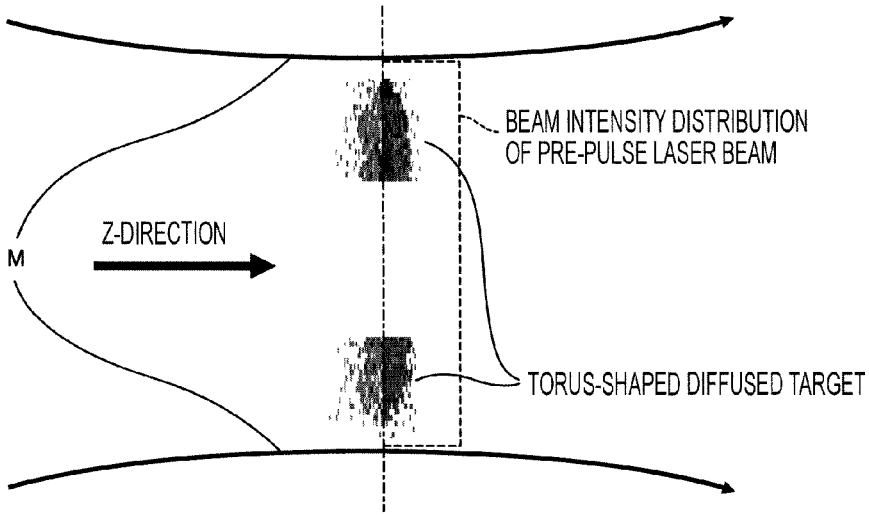
FIG. 18B is a conceptual diagram showing a torus-shaped diffused target, which has been formed as a droplet is irradiated with a pre-pulse laser beam, being irradiated with a main pulse laser beam having a top-hat beam intensity distribution, as viewed in the direction perpendicular to the beam axis.
Figure 18C:
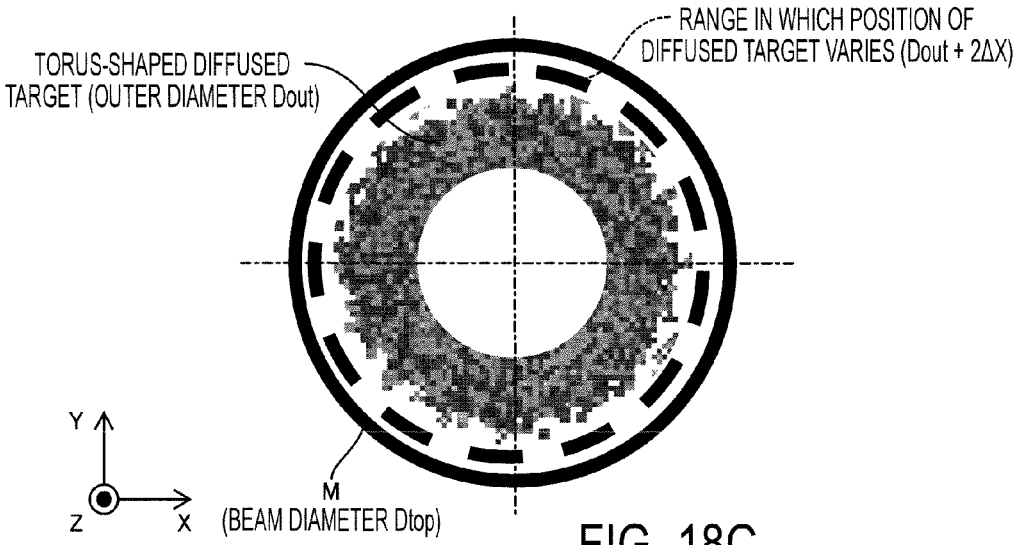
FIG. 18C is a conceptual diagram showing a torus-shaped diffused target, which has been formed as a droplet is irradiated with a pre-pulse laser beam, being irradiated with a main pulse laser beam having a top-hat beam intensity distribution, as viewed in the direction of the beam axis.

FIG. 18A is a conceptual diagram showing the droplet DL being irradiated with the pre-pulse laser beam P. FIGS. 18B and 18C are conceptual diagrams showing that a torus-shaped diffused target, which has been formed when the droplet DL is irradiated with the pre-pulse laser beam P, is irradiated with the main pulse laser beam M having a top-hat beam intensity distribution. FIGS. 18A and 18B are diagrams viewed in the direction perpendicular to the beam axes of the pre-pulse laser beam P and the main pulse laser beam M. FIG. 18C is a diagram viewed in the direction of the beam axis of the main pulse laser beam M.

As shown in FIG. 18A, when the pre-pulse laser beam P is focused on the droplet DL, laser ablation may occur at the surface of the droplet DL irradiated with the pre-pulse laser beam P. A shock wave may occur from the irradiated surface of the droplet DL toward the interior of the droplet DL due to the energy by the laser ablation. This shock wave may propagate throughout the droplet DL. When the beam intensity of the pre-pulse laser beam P is equal to or greater than a first value (e.g., $1\times10^9$ W/cm$^2$), the droplet DL may be broken up by the shock wave and be diffused.

Here, when the beam intensity of the pre-pulse laser beam P is equal to or greater than a second value (e.g., $6.4\times10^9$ W/cm$^2$), the droplet DL may be broken up to form a torus-shaped diffused target as shown in FIGS. 18B and 18C. As shown in FIGS. 18B and 18C, the torus-shaped diffused target may be diffused into a torus-shape symmetrically about the beam axis of the pre-pulse laser beam P.

Specific conditions for generating a torus-shaped diffused target may, for example, be as follows. The range of the beam intensity of the pre-pulse laser beam P may be from $6.4\times10^9$ W/cm$^2$ to $3.2\times10^{10}$ W/cm$^2$ inclusive. The droplet DL may be 12 μm to 40 μm inclusive in diameter.

Irradiation of the torus-shaped diffused target with the main pulse laser beam M will now be discussed. For example, the torus-shaped diffused target may, for example, be formed in 0.5 μs to 2.0 μs after the droplet DL is irradiated with the pre-pulse laser beam P. Accordingly, the diffused target may preferably be irradiated with the main pulse laser beam M in the aforementioned period after the droplet DL is irradiated with the pre-pulse laser beam P.

Further, as shown in FIGS. 18B and 18C, the torus-shaped diffused target may be shaped such that the length in the direction of the beam axis of the pre-pulse laser beam P is shorter than the length in the direction perpendicular to the beam axis of the pre-pulse laser beam P. The torus-shaped diffused target of such dimensions may preferably be irradiated with the main pulse laser beam M in the same direction as the pre-pulse laser beam P. Accordingly, the diffused target may be irradiated with the main pulse laser beam M more uniformly, and thus the main pulse laser beam M may be absorbed efficiently by the diffused target. In turn, the conversion efficiency (CE) in the LPP type EUV light generation system may be improved.

In order to generate a torus-shaped diffused target, the pre-pulse laser beam P may not need to have a top-hat beam intensity distribution. In that case, the beam-shaping optical system 31 shown in FIG. 17 may be omitted. However, the beam-shaping optical system 31 may be provided in order to reduce the variation in the position of the diffused target resulting from the variation in the position of the droplet DL.

It is speculated that when the torus-shaped diffused target is irradiated with the main pulse laser beam M having a top-hat beam intensity distribution, plasma is emitted cylindrically from the torus-shaped diffused target. Then, the plasma diffused toward the inner portion of the cylinder may be trapped therein. This may generate high-temperature, high-density plasma, and improve the CE. Here, the term "torus-shape" means an annular shape, but the diffused target need not be perfectly annular in shape, and may be substantially annular in shape. The torus-shaped diffused target comprises particles of the target material which is diffused by the pre-pulse laser beam P. The particles aggregate to have the torus shape.

When the variation in the position of the torus-shaped diffused target is ΔX, a diameter Dtop of a region where the beam intensity distribution of the main pulse laser beam M has substantial uniformity may preferably be in the following relationship with an outer diameter Dout of the torus-shaped diffused target.

$$Dtop \geq Dout + 2\Delta X$$

That is, the diameter Dtop of the aforementioned region may preferably be equal to or larger than the sum of the outer diameter Dout of the torus-shaped diffused target and double the variation ΔX (2ΔX) in the position of the torus-shaped diffused target. With this configuration, the entire torus-shaped diffused target may be irradiated with the main pulse laser beam M at substantially uniform beam intensity. Accordingly, a larger portion of the diffused target may be turned into plasma. As a result, debris of the target material may be reduced.

10. Fifth Embodiment

Figure 19:
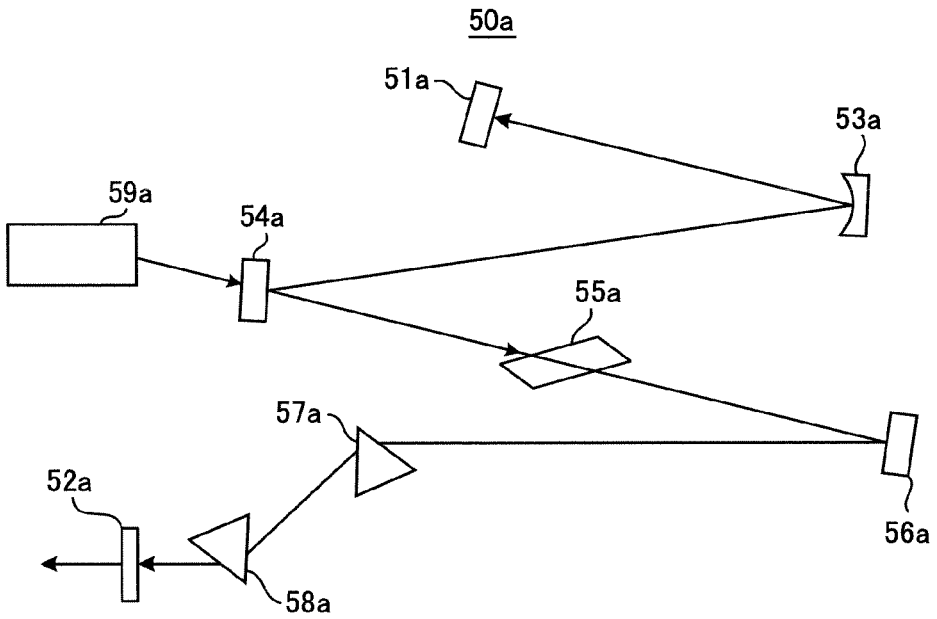
FIG. 19 schematically illustrates an exemplary configuration of a Ti:sapphire laser configured to output a pre-pulse laser beam in an EUV light generation system according to a fifth embodiment.

FIG. 19 schematically illustrates an exemplary configuration of a Ti:sapphire laser configured to output the pre-pulse laser beam P in an EUV light generation system according to a fourth embodiment. A Ti:sapphire laser 50*a* of the fifth embodiment may be provided outside the chamber 1 as a pre-pulse laser apparatus.

The Ti:sapphire laser 50*a* may include a laser resonator formed by a semiconductor saturable absorber mirror 51*a* and an output coupler 52*a*. A concave mirror 53*a*, a first pumping mirror 54*a*, a Ti:sapphire crystal 55*a*, a second pumping mirror 56*a*, and two prisms 57*a* and 58*a* are provided in this order from the side of the semiconductor saturable absorber mirror 51*a* in the optical path in the laser resonator. Further, the Ti:sapphire laser 50*a* may include a pumping source 59*a* for introducing a pumping beam into the laser resonator.

The first pumping mirror 54*a* may be configured to transmit the pumping beam from the outside of the laser resonator with high transmittance and reflect the laser beam inside the laser resonator with high reflectance. The Ti:sapphire crystal 55*a* may serve as a laser medium that undergoes stimulated emission with the pumping beam. The two prisms 57*a* and 58*a* may selectively transmit a laser beam at a wavelength. The output coupler 52*a* may transmit a part of the laser beam amplified in the laser resonator and output the amplified laser beam from the laser resonator, and reflect the remaining part of the laser beam back into the laser resonator. The semiconductor saturable absorber mirror 51*a* may have a reflective layer and a saturable absorber layer laminated thereon. A part of an incident laser beam of low beam intensity may be absorbed by the saturable absorber layer, and another part of the incident laser beam of high beam intensity may be transmitted through the saturable absorber layer and reflected by the reflective layer. With this, the pulse duration of the incident laser beam may be shortened.

A semiconductor pumped Nd:$YVO_4$ laser may be used as the pumping source 59*a*. The second harmonic wave from the pumping source 59*a* may be introduced into the laser resonator through the first pumping mirror 54*a*. The position of the semiconductor saturable absorber mirror 51*a* may be adjusted so as to adjust the resonator length for a given longitudinal mode. This adjustment may lead to mode-locking of the Ti:sapphire laser 50*a*, and a picosecond pulse laser beam may be outputted through the output coupler 52*a*. Here, when the pulse energy is small, the pulse laser beam may be amplified by a regenerative amplifier.

According to the fifth embodiment, the picosecond pulse laser beam may be outputted, and the droplet DL may be irradiated with the pre-pulse laser beam P having such a pulse duration. Accordingly, the droplet DL can be diffused with relatively small pulse energy.

11. Sixth Embodiment

Figure 20:
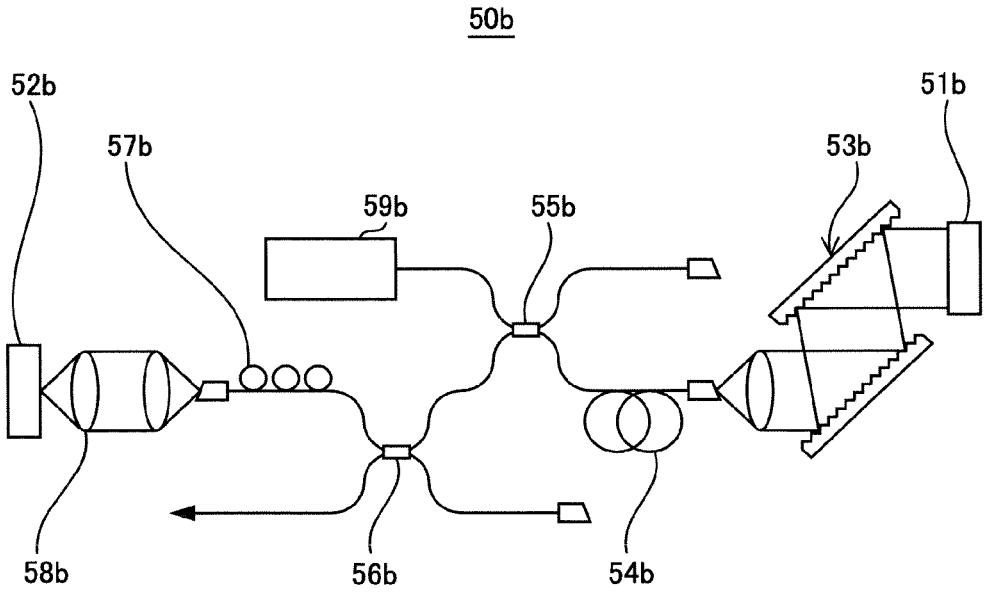
FIG. 20 schematically illustrates an exemplary configuration of a fiber laser configured to output a pre-pulse laser beam in an EUV light generation system according to a sixth embodiment.

FIG. 20 schematically illustrates an exemplary configuration of a fiber laser configured to output the pre-pulse laser beam P in an EUV light generation system according to a sixth embodiment. A fiber laser 50*b* of the sixth embodiment may be provided outside the chamber 1 as a pre-pulse laser apparatus.

The fiber laser 50*b* may include a laser resonator formed by a high-reflection mirror 51*b* and a semiconductor saturable absorber mirror 52*b*. A grating pair 53*b*, a first polarization maintenance fiber 54*b*, a multiplexer 55*b*, a separation element 56*b*, a second polarization maintenance fiber 57*b*, and a focusing optical system 58*b* may be provided in this order from the side of the high-reflection mirror 51*b* in the beam path in the laser resonator. Further, the fiber laser 50*b* may include a pumping source 59*b* for introducing a pumping beam into the laser resonator.

The multiplexer 55*b* may be configured to introduce the pumping beam from the pumping source 59*b* to the first polarization maintenance fiber 54*b* and may transmit a laser beam traveling back and forth between the first polarization maintenance fiber 54*b* and the second polarization maintenance fiber 57*b*. The first polarization maintenance fiber 54*b* may be doped with ytterbium (Yb), and may undergo stimulated emission with the pumping beam. The grating pair 53*b* may selectively reflect a laser beam at a wavelength. The semiconductor saturable absorber mirror 52*b* may be similar in configuration and function to the semiconductor saturable absorber mirror 51*b* in the fifth embodiment. The separation element 56*b* may separate a part of the laser beam amplified in the laser resonator and output the separated laser beam from the laser resonator and return the remaining part of the laser beam back into the laser resonator. This configuration may lead to mode-locking of the fiber laser 50*b*. When the pumping beam from the pumping source 59*b* is introduced into the multiplexer 55*b* through an optical fiber, and a picosecond pulse laser beam may be outputted through the separation element 56*b*.

According to the sixth embodiment, in addition to the effects obtained in the fifth embodiment, the direction of the pre-pulse laser beam P may easily be adjusted since the pre-pulse laser beam P is guided through an optical fiber.

The shorter the wavelength of a laser beam, the higher the absorptivity of the laser beam by tin. Accordingly, when the priority is placed on the absorptivity of the laser beam by tin, a laser beam at a shorter wavelength may be advantageous. For example, compared to the fundamental harmonic wave outputted from an Nd:YAG laser apparatus at a wavelength of 1064 nm, the absorptivity may increase with the second harmonic wave (a wavelength of 532 nm), further with the third harmonic wave (a wavelength of 355 nm), and even further with the fourth harmonic wave (a wavelength of 266 nm).

Here, an example where a picosecond pulse laser beam is used is shown. However, similar effects can be obtained even with a femtosecond pulse laser beam. Further, a droplet can be diffused even with a nanosecond pulse laser beam. For example, a fiber laser with such specifications as a pulse duration of approximately 15 ns, a repetition rate of 100 kHz, pulse energy of 1.5 mJ, a wavelength of 1.03 μm, and the $M^2$ value of below 1.5 may be used as a pre-pulse laser apparatus.

12. Irradiation Conditions Of Pre-pulse Laser Beam

FIG. 21 is a table showing examples of irradiation conditions of the pre-pulse laser beam P in this disclosure. When the irradiation pulse energy is E (J), the pulse duration is T (s), and the diameter of a region where the beam intensity distribution has substantial uniformity is Dt (m), the beam intensity W ($W/m^2$) of the pre-pulse laser beam P may be expressed in the following expression.

$$W=E/(T(Dt/2)^2\pi)$$

FIG. 21 shows four examples (case 1 through case 4) of the irradiation conditions of the pre-pulse laser beam P. In each of the cases 1 through 4, the diameter of a molten tin droplet is 10 μm, and the diameter Dt of a region where the beam intensity distribution has substantial uniformity is 30 μm.

In the case 1, in order to generate a desired diffused target by diffusing such a droplet, the irradiation pulse energy E is set to 0.3 mJ, and the pulse duration T is set to 20 ns. In this case, the beam intensity W of $2.12\times10^9$ $W/cm^2$ may be obtained. With such a pre-pulse laser beam P, a diffused target as shown in FIG. 2B may be generated.

In the case 2, the irradiation pulse energy E is set to 0.3 mJ, and the pulse duration T is set to 10 ns. In this case, the beam intensity W of $4.24\times10^9$ $W/cm^2$ may be obtained. With such a pre-pulse laser beam P, a diffused target as shown in FIG. 2B may be generated.

In the case 3, the irradiation pulse energy E is set to 0.3 mJ, and the pulse duration T is set to 0.1 ns. In this case, the beam intensity W of $4.24\times10^{11}$ $W/cm^2$ may be obtained. With such a pre-pulse laser beam P, a diffused target as shown in FIG. 3B may be generated.

In the case 4, the irradiation pulse energy E is set to 0.5 mJ, and the pulse duration T is set to 0.05 ns. In this case, the beam intensity W of $1.41\times10^{12}$ $W/cm^2$ may be obtained. With such a pre-pulse laser beam P, a diffused target as shown in FIG. 3B may be generated. In this way, the high beam intensity W may be obtained when a picosecond pulse laser beam is used as the pre-pulse laser beam P.

In the cases shown in FIG. 21, the droplet having a diameter of 10 μm is used. This disclosure, however, is not limited thereto. For example, when the variation ΔX in the position of the droplet DL having a diameter of 16 μm is 7 μm, the diameter Dt of a region where the beam intensity distribution has substantial uniformity may be set to 30 μm.

13. Seventh Embodiment

Figure 22:
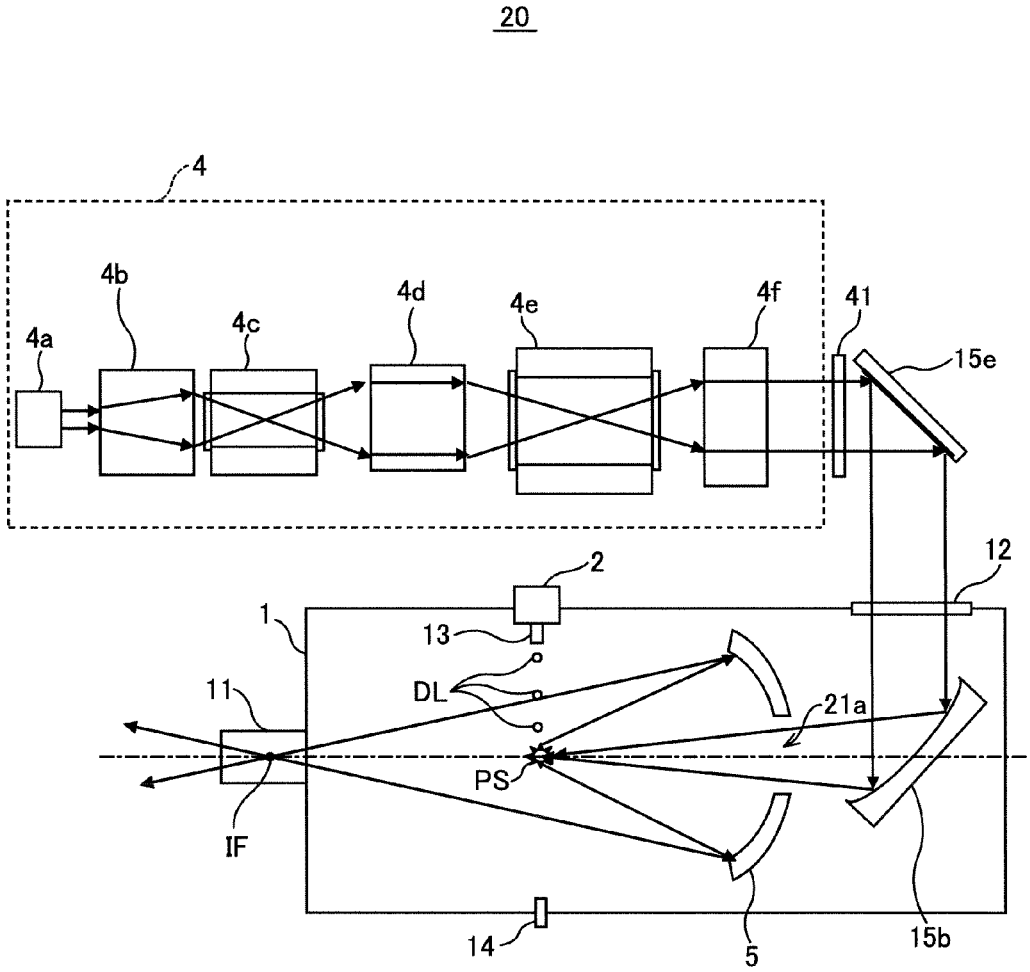
FIG. 22 schematically illustrates an exemplary configuration of an EUV light generation system according to a seventh embodiment.

FIG. 22 schematically illustrates an exemplary configuration of an EUV light generation system according to a seventh embodiment. The EUV light generation system according to the seventh embodiment may differ from the EUV light generation system according to the fourth embodiment described with reference to FIG. 17 in that the pre-pulse laser apparatus 3 (see FIG. 17) is not provided. In the EUV light generation system of the seventh embodiment, the droplet DL may be turned into plasma with only the main pulse laser beam M.

In the seventh embodiment, the beam-shaping optical system 41 may adjust the beam intensity distribution of the main pulse laser beam M so as to include a region where the beam intensity distribution along a cross-section has substantial uniformity. With this configuration, even when the position of the droplet DL varies within the aforementioned region when the droplet DL is irradiated with the main pulse laser beam M, the variation in the irradiation beam intensity of the main pulse laser beam on the droplet DL may be kept small. As a result, the stability in the generated plasma density may be improved, and the energy of the generated EUV light may be stabilized.

14. Eighth Embodiment

Figure 23:
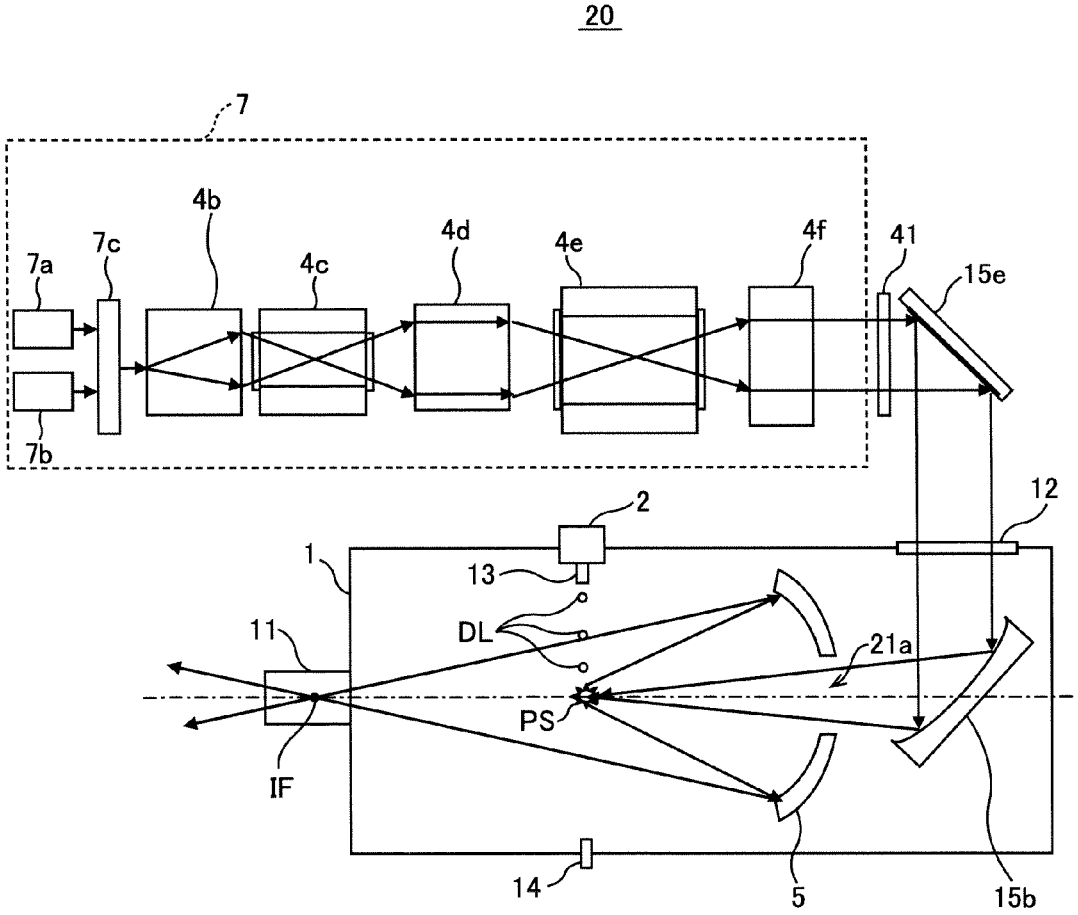
FIG. 23 schematically illustrates an exemplary configuration of an EUV light generation system according to an eighth embodiment.

FIG. 23 schematically illustrates an exemplary configuration of an EUV light generation system according to an eighth embodiment. The EUV light generation system according to the eighth embodiment may include a laser apparatus 7 configured to output both the pre-pulse laser beam P and the main pulse laser beam M.

The laser apparatus 7 may include a first master oscillator 7*a*, a second master oscillator 7*b*, a beam path adjusting unit 7*c*, the preamplifier 4*c*, the main amplifier 4*e*, and the relay optical systems 4*b*, 4*d*, and 4*f*. The first master oscillator 7*a* may be configured to generate a seed beam of the pre-pulse laser beam P. The second master oscillator 7*b* may be configured to generate a seed beam of the main pulse laser beam M. The seed beams generated by the first and second master oscillators 7*a* and 7*b*, respectively, may preferably be in the same bandwidth. The beam path adjusting unit 7*c* may adjust the beam paths of the seed beams to overlap spatially with each other and output the seed beams to the relay optical system 4*b*.

Each of the pre-pulse laser beam P and the main pulse laser beam M outputted from the laser apparatus 7 may have the beam intensity distribution thereof adjusted by the beam-shaping optical system 41 so as to include a region where the beam intensity distribution has substantial uniformity. When the wavelengths of the pre-pulse laser beam P and the main pulse laser beam M are contained within the same bandwidth, the beam intensity distribution of both laser beams may be adjusted by a signal beam-shaping optical system 41.

15. Ninth Embodiment 15.1 Configuration

Figure 24:
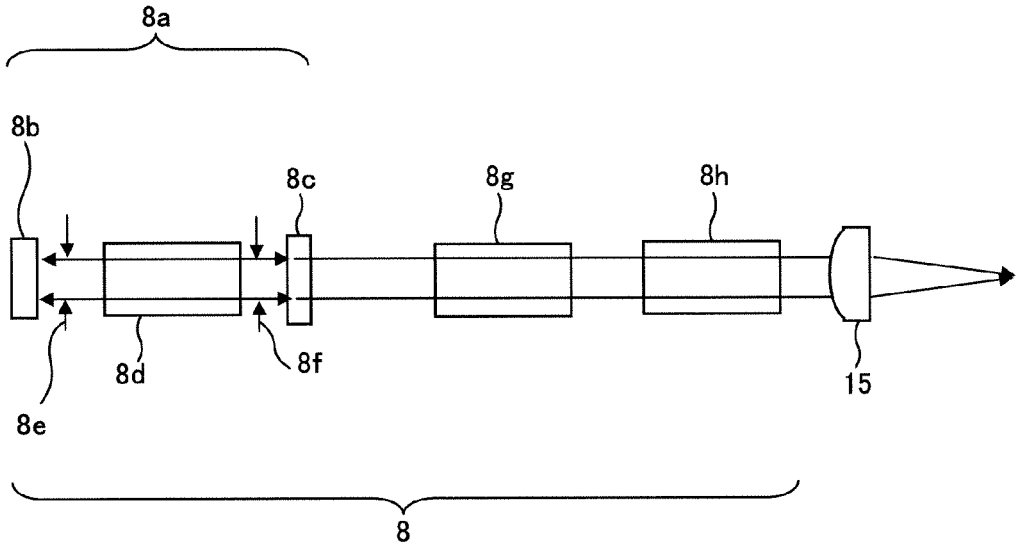
FIG. 24 schematically illustrates an exemplary configuration of a laser apparatus used in an EUV light generation system according to a ninth embodiment.

FIG. 24 schematically illustrates an exemplary configuration of a laser apparatus used in an EUV light generation system according to a ninth embodiment. A laser apparatus 8 of the ninth embodiment may be provided outside the chamber 1 as a pre-pulse laser apparatus.

The laser apparatus 8 may include a master oscillator 8*a*, a preamplifier 8*g*, and a main amplifier 8*h*. The preamplifier 8*g* and the main amplifier 8*h* may be provided in the beam path of a laser beam from the master oscillator 8*a*.

The master oscillator 8*a* may include a stable resonator formed by a high-reflection mirror 8*b* and a partial reflection mirror 8*c*, and a laser medium 8*d*. The laser medium 8*d* may be provided between the high-reflection mirror 8*b* and the partial reflection mirror 8*c*. The laser medium 8*d* may be an Nd:YAG crystal, a Yb:YAG crystal, or the like. The crystal may be columnar or planar.

Each of the high-reflection mirror 8*b* and the partial reflection mirror 8*c* may be a flat mirror or a curved mirror. Aperture plates 8*e* and 8*f* each having an aperture formed therein may be provided in the beam path in the stable resonator.

Each of the preamplifier 8*g* and the main amplifier 8*h* may include a laser medium. This laser medium may be an Nd:YAG crystal, a Yb:YAG crystal, or the like. The crystal may be columnar or planar.

15.2 Operation

When the laser medium 8*d* in the master oscillator 8*a* is excited by a pumping beam from a pumping source (not shown), the stable resonator formed by the high-reflection mirror 8*b* and a partial reflection mirror 8*c* may oscillate in a multi-traverse mode. The cross-sectional shape of the multi-traverse mode laser beam may be modified in accordance with the shape of the apertures formed in the respective aperture plates 8*e* and 8*f* provided in the stable resonator. With this configuration, a laser beam having a cross-sectional shape in accordance with the shape of the apertures and a top-hat beam intensity distribution at a spot may be outputted from the master oscillator 8*a*. The laser beam from the master oscillator 8*a* may be amplified by the preamplifier 8*g* and the main amplifier 8*h*, and the amplified laser beam may be focused by the focusing optical system 15 on the droplet DL. With this configuration, a laser beam having a top-hat beam intensity distribution may be generated without using a beam-shaping optical system.

When the apertures formed in the respective aperture plates 8*e* and 8*f* are rectangular, the cross-sectional shape of the laser beam having a top-hat beam intensity distribution may become rectangular. When the apertures formed in the respective aperture plates 8*e* and 8*f* are circular, the cross-sectional shape of the laser beam having a top-hat beam intensity distribution may become circular. When the direction into which the position of the droplet DL varies fluctuates, the cross-sectional shape of the laser beam having a top-hat beam intensity distribution may be made rectangular by using the aperture plates 8*e* and 8*f* having rectangular apertures formed therein. In this way, the cross-sectional shape of the laser beam having a top-hat beam intensity distribution at a spot may be adjusted by selecting or adjusting the shape of the apertures. Further, without being limited to the use of the aperture plate, the cross-sectional shape of the laser beam may be controlled by the cross-sectional shape of the laser medium 8*d*.

16. Control Of Fluence

Figure 25:
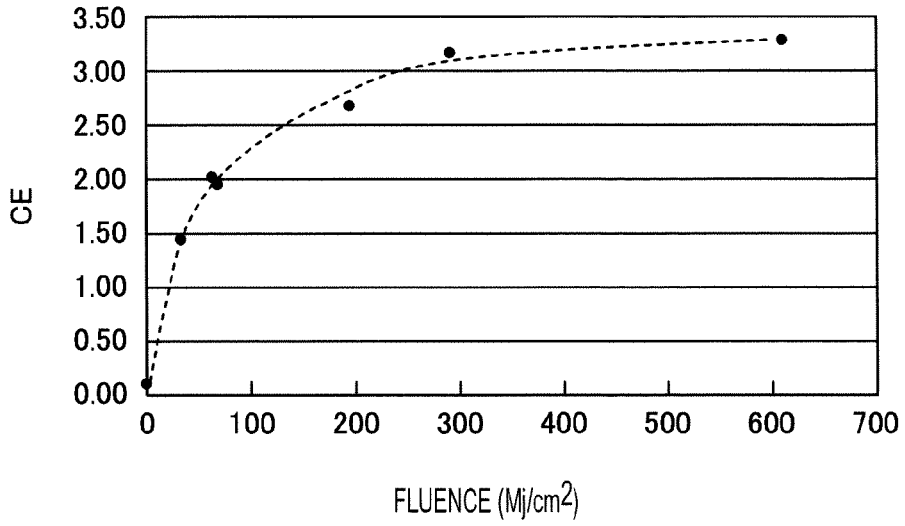
FIG. 25 is a graph on which the obtained conversion efficiency (CE) for the corresponding fluence of a pre-pulse laser beam is plotted.

FIG. 25 is a graph on which the obtained conversion efficiency (CE) for the corresponding fluence of the pre-pulse laser beam is plotted. The fluence may be defined as energy per unit area in a cross-section of a laser beam at its focus.

The measuring conditions are as follows. A molten tin droplet of 20 μm in diameter is used as a target material. A laser beam with a pulse duration of 5 ns to 15 ns outputted from a YAG laser apparatus is used as a pre-pulse laser beam. A laser beam with a pulse duration of 20 ns outputted from a $CO_2$ laser apparatus is used as a main pulse laser beam. The beam intensity of the main pulse laser beam is $6.0\times10^9$ W/cm$^2$, and the delay time for the irradiation with the main pulse laser beam is 1.5 μs from the irradiation with the pre-pulse laser beam.

The horizontal axis of the graph shown in FIG. 25 shows a value obtained by converting the irradiation conditions of the pre-pulse laser beam (pulse duration, energy, and spot size) into a fluence. The vertical axis shows the CE obtained in the case where each of the diffused targets generated in accordance with the respective irradiation conditions of the pre-pulse laser beam is irradiated with the main pulse laser beam of substantially the same condition.

The measurement results shown in FIG. 25 reveal that increasing the fluence of the pre-pulse laser beam may improve the CE (approximately 3%). That is, at least in a range where the pulse duration of the pre-pulse laser beam is 5 ns to 15 ns, there is a correlation between the fluence and the CE.

Accordingly, in the above-described embodiments, the fluence, instead of the beam intensity, of the pre-pulse laser beam may be controlled. The measurement results shown in FIG. 25 reveal that the fluence of the pre-pulse laser beam may preferably be in the range of 10 mJ/cm$^2$ to 600 mJ/cm$^2$. The range of 30 mJ/cm$^2$ to 400 mJ/cm$^2$ is more preferable. The range of 150 mJ/cm$^2$ to 300 mJ/cm$^2$ is even more preferable.

17. Control Of Delay Time

Figure 26:
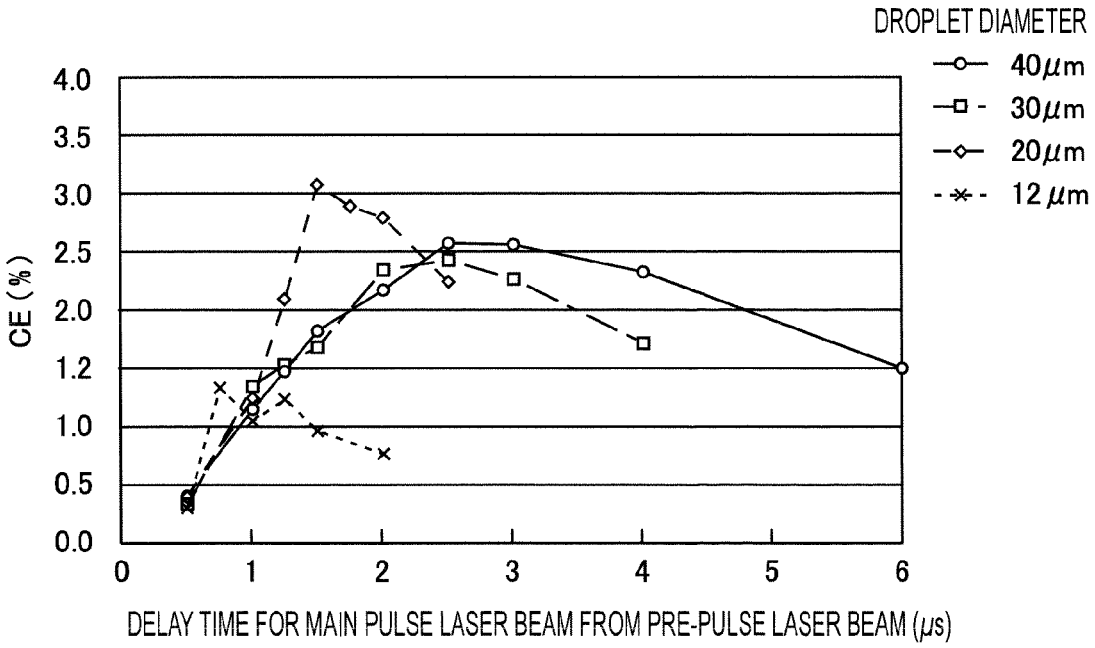
FIG. 26 is a graph on which the obtained CE for the corresponding delay time since a droplet is irradiated with a pre-pulse laser beam until a diffused target is irradiated by a main pulse laser beam for differing diameters of the droplet.

FIG. 26 is a graph on which the obtained CE for the corresponding delay time since a droplet is irradiated with a pre-pulse laser beam until a diffused target is irradiated by a main pulse laser beam is plotted for differing diameters of the droplet.

The measuring conditions are as follows. Molten tin droplets of 12 μm, 20 μm, 30 μm, and 40 μm in diameter are used as the target material. A laser beam with a pulse duration of 5 ns outputted from a YAG laser apparatus is used as a pre-pulse laser beam. The fluence of the pre-pulse laser beam is 490 mJ/cm$^2$. A laser beam with a pulse duration of 20 ns outputted from a $CO_2$ laser apparatus is used as a main pulse laser beam. The beam intensity of the main pulse laser beam is $6.0\times10^9$ W/cm$^2$.

The measurement results shown in FIG. 26 reveal that the delay time for the irradiation with the main pulse laser beam may preferably be in a range of 0.5 μs to 2.5 μs from the irradiation with the pre-pulse laser beam. More specifically, the optimum range of the delay time for the irradiation with the main pulse laser beam to obtain a high CE may differ depending on the diameters of the droplets.

When the diameter of the droplet is 12 μm, the delay time for the irradiation with the main pulse laser beam may preferably be in a range of 0.5 μs to 2 μs from the irradiation with the pre-pulse laser beam. The range of 0.6 μs to 1.5 μs is more preferable. The range of 0.7 μs to 1 μs is even more preferable.

When the diameter of the droplet is 20 μm, the delay time for the irradiation with the main pulse laser beam may preferably be in a range of 0.5 μs to 2.5 μs from the irradiation with the pre-pulse laser beam. The range of 1 μs to 2 μs is more preferable. The range of 1.3 μs to 1.7 μs is even more preferable.

When the diameter of the droplet is 30 μm, the delay time for the irradiation with the main pulse laser beam may preferably be in a range of 0.5 μs to 4 μs from the irradiation with the pre-pulse laser beam. The range of 1.5 μs to 3.5 μs is more preferable. The range of 2 μs to 3 μs is even more preferable.

When the diameter of the droplet is 40 μm, the delay time for the irradiation with the main pulse laser beam may preferably be in a range of 0.5 μs to 6 μs from the irradiation with the pre-pulse laser beam. The range of 1.5 μs to 5 μs is more preferable. The range of 2 μs to 4 μs is even more preferable.

The above-described embodiments and the modifications thereof are merely examples for implementing this disclosure, and this disclosure is not limited thereto. Making various modifications according to the specifications or the like is within the scope of this disclosure, and other various embodiments are possible within the scope of this disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. An apparatus comprising:

a chamber;

a target supply for supplying a target material to a region inside the chamber;

a focusing optical system for focusing a laser beam on the region, the laser beams including (1) a pre-pulse laser beam with which the target material is irradiated and (2) a main pulse laser beam with which the target material is irradiated subsequent to the pre-pulse laser beam;

a laser apparatus configured to generate the pre-pulse laser beam having a pulse duration of less than 1 ns and to generate the main pulse laser beam;

an intensity control optical system for controlling intensity distribution of the pre-pulse laser beam has a uniform intensity distribution region in a first cross-section with which the target material is irradiated, the uniform intensity distribution region in the first cross-section being perpendicular to a first traveling path of the pre-pulse laser beam, a variation value $C=\{(Imax-Imin)/(Imax+Imin)\}\times100(\%)$ being equal to or less than 20%, where Imax is the highest beam intensity in the uniform intensity distribution region and Imin is the lowest beam intensity in the uniform intensity distribution region;

a first detector configured to detect that the target material reaches a predetermined position along the first traveling path;

a laser trigger generator configured to, responsive to the detection of the first detector, generate a trigger signal to control generation of the pre-pulse laser beam and the main pulse laser beam;

a second detector configured to detect a second traveling path of the target material; and a droplet controller configured to control the target supply to adjust the second traveling path when a deviation of the second traveling path is out of a permissible range, wherein:

an area of the uniform intensity distribution region of the first cross-section the pre-pulse laser beam is larger than an area of the maximum cross section of the target material, the maximum cross section of the target material being perpendicular to the first traveling path of the pre-pulse laser beam, and the main pulse laser beam does not have a uniform intensity distribution region in a second cross-section with which the target material is irradiated, the uniform intensity distribution region in the second cross-section being perpendicular to a third traveling path of the main pulse laser beam.

2. The apparatus according to claim 1, wherein the laser apparatus comprising:

a first oscillator for generating a first seed light of the pre-pulse laser beam;

a second oscillator for generating a second seed light of the main pulse laser beam; and at least one amplifier for amplifying the first seed light and the second seed light to generate the pre-pulse laser beam and the main pulse laser beam, respectively.

3. The apparatus according to claim 1, wherein the laser apparatus comprises;

a first laser apparatus for outputting the pre-pulse laser beam, the first laser apparatus including:

an oscillator comprising an optical resonator including two mirrors and a laser medium arranged between the two mirrors, one of the two mirrors having an aperture for outputting a seed laser beam having a uniform intensity distribution region of a cross-section perpendicular to a traveling path of the seed laser beam; and at least one amplifier for amplifying the seed laser beam to output the pre-pulse laser beam, the pre-pulse laser beam having a uniform intensity distribution region of a cross-section perpendicular to a traveling path of the pre-pulse laser beam; and a second laser apparatus for outputting the main pulse laser beam.

4. The apparatus according to claim 1, wherein the pre-pulse laser beam causes the target material to become a particle aggregate of the target material having a torus shape in a cross section perpendicular to the traveling path of the pre-pulse laser beam.

5. A method for generating extreme ultraviolet light, the method comprising the steps of:

(a) supplying a droplet of a target material o a region inside a chamber;

(b) diffusing the droplet by irradiating the droplet by a pre-pulse laser beam having a pulse duration of less than 1 ns to form a diffused target, the pre-pulse laser beam has a uniform intensity distribution region in a first cross-section with which the target material is irradiated, the uniform intensity distribution region in the first cross-section being perpendicular to a first traveling path of the pre-pulse laser beam, a variation value $C=\{(Imax-Imin)/(Imax+Imin)\}\times 100(\%)$ being equal to or smaller than 20%, where Imax is the highest beam intensity in the uniform intensity distribution region and Imin is the lowest beam intensity in the uniform intensity distribution region; and (c) generating plasma by irradiating the diffused target by a main pulse laser beam and generating extreme ultraviolet light from the plasma, the main pulse laser beam does not have a uniform intensity distribution region in a second cross-section with which the target material is irradiated, the uniform intensity distribution region in the second cross-section being perpendicular to a second traveling path of the main pulse laser beam, wherein the step (b) comprises diffusing the droplet annularly and symmetrically about the second traveling path of the main pulse laser beam.

6. The apparatus according to claim 1, wherein the intensity distribution control optical system controls the intensity distribution of the pre-pulse laser beam so that there are multiple peaks within the uniform intensity distribution region and that a gap between two adjacent peaks is equal to or smaller than a half of diameter of a droplet of the target material.

7. The apparatus according to claim 6, wherein the diameter of the uniform intensity distribution region is equal to or larger than $Dd+2\Delta X$, where Dd represents the diameter of the droplet and $\Delta X$ represents variation of the position of the droplet.

8. The apparatus according to claim 7, wherein the laser apparatus generates the pre-pulse laser beam having a wavelength smaller than a wavelength of the main pulse laser beam.

9. The apparatus according to claim 8, wherein the laser apparatus comprises:

a first laser apparatus for outputting the pre-pulse laser beam, the first laser apparatus including a YAG laser apparatus: and a second laser apparatus for outputting the main pulse laser beam, the second laser apparatus including a $CO_2$ laser apparatus.

10. The apparatus according to claim 9, wherein the pre-pulse laser beam has a wavelength of 1.06 μm and the main pulse laser beam has a wavelength of 10.6 μm.

* * * * *